US012453418B2

(12) United States Patent
Feuerstein

(10) Patent No.: US 12,453,418 B2
(45) Date of Patent: Oct. 28, 2025

(54) METHOD FOR PRODUCING A DOUBLE-WALLED DRAWER FRAME BY HAND AND/OR BY MACHINE

(71) Applicant: Julius Blum GmbH, Hoechst (AT)

(72) Inventor: Markus Feuerstein, Gaussau (AT)

(73) Assignee: Julius Blum GmbH, Hoechst (AT)

( * ) Notice: Subject to any disclaimer, the term of this patent is extended or adjusted under 35 U.S.C. 154(b) by 279 days.

(21) Appl. No.: 18/200,740

(22) Filed: May 23, 2023

(65) Prior Publication Data

US 2023/0292919 A1 Sep. 21, 2023

Related U.S. Application Data

(63) Continuation of application No. PCT/AT2021/060443, filed on Nov. 23, 2021.

(30) Foreign Application Priority Data

Dec. 2, 2020 (AT) ..... A 51051/2020

(51) Int. Cl.
*A47B 88/90* (2017.01)

(52) U.S. Cl.
CPC ..... *A47B 88/941* (2017.01); *A47B 2210/02* (2013.01)

(58) Field of Classification Search
CPC ..... A47B 88/941; A47B 88/90; A47B 88/906; A47B 2210/02
See application file for complete search history.

(56) References Cited

U.S. PATENT DOCUMENTS 3,826,554 A * 7/1974 Cornell ..... A47B 88/9412 312/348.1
5,197,791 A * 3/1993 Domenig ..... A47B 88/941 312/348.1
5,292,190 A * 3/1994 Lautenschlager .... A47B 88/941 428/35.8
5,370,454 A 12/1994 Domenig
(Continued)

FOREIGN PATENT DOCUMENTS

CN 104066357 9/2014
CN 111511250 8/2020
(Continued)

OTHER PUBLICATIONS

WO 2020182583 translation (Year: 2025).*
(Continued)

*Primary Examiner* — Daniel J Rohrhoff
(74) *Attorney, Agent, or Firm* — Wenderoth, Lind & Ponack, L.L.P.

(57) ABSTRACT

A method is provided for producing, by machine and/or by hand, a double-walled drawer frame for a drawer including an inner wall and an outer wall. The method includes the following, in particular carried out chronologically in the order indicated: arranging a spacer part on the inner wall and/or the outer wall, arranging the two walls substantially parallel with each other, displacing the two walls relative to each other in a direction parallel with a longitudinal direction of the walls and/or in a direction transverse to the longitudinal direction, and joining the two walls to each other in the course of the displacement movement.

32 Claims, 22 Drawing Sheets

(56) References Cited

U.S. PATENT DOCUMENTS

| | | | | |
|---|---|---|---|---|
| 9,456,690 | B2 | 10/2016 | Feuerstein | |
| 10,729,242 | B2 | 8/2020 | Staufenberg et al. | |
| 2006/0005502 | A1* | 1/2006 | Bodingbauer | A47B 88/90 52/842 |
| 2014/0285080 | A1 | 9/2014 | Feuerstein | |
| 2016/0106213 | A1* | 4/2016 | Grabher | A47B 88/941 312/334.7 |
| 2018/0132616 | A1* | 5/2018 | Salice | A47B 88/95 |
| 2019/0357678 | A1 | 11/2019 | Staufenberg et al. | |
| 2020/0305601 | A1 | 10/2020 | Irgang et al. | |
| 2020/0315346 | A1* | 10/2020 | Kampl | A47B 88/90 |
| 2020/0315348 | A1* | 10/2020 | Irgang | A47B 88/956 |

FOREIGN PATENT DOCUMENTS

| | | | |
|---|---|---|---|
| CN | 111655079 | 9/2020 | |
| DE | 36 09 621 | 9/1987 | |
| DE | 20 2019 107 248 | 3/2020 | |
| DE | 10 2019 113 101 | 11/2020 | |
| EP | 1 614 369 | 1/2006 | |
| JP | 48-83953 | 10/1973 | |
| JP | 2015-504712 | 2/2015 | |
| JP | 2015-66181 | 4/2015 | |
| JP | 2020-513261 | 5/2020 | |
| WO | 2012/156390 | 11/2012 | |
| WO | 2013/090951 | 6/2013 | |
| WO | 2015/172164 | 11/2015 | |
| WO | 2019/149632 | 8/2019 | |
| WO | WO-2019149632 A1 * | 8/2019 | A47B 88/941 |
| WO | WO-2020182583 A1 * | 9/2020 | A47B 88/919 |
| WO | 2020/225027 | 11/2020 | |

OTHER PUBLICATIONS

Wo2019149632 translation (Year: 2025).*

International Search Report issued Feb. 24, 2022 in International (PCT) Application No. PCT/AT2021/060443.

* cited by examiner

C(2:1)
A(2:1)
B(2:1)
A
B
C
1
2
4
5
6
7
9
11
13
51
53
62
71
72,73
74

C(2:1)
A(2:1)
B(2:1)
A
B
C
1
2
3
4
5
6
7
9
11
13
51
52,54
53
62
72,73

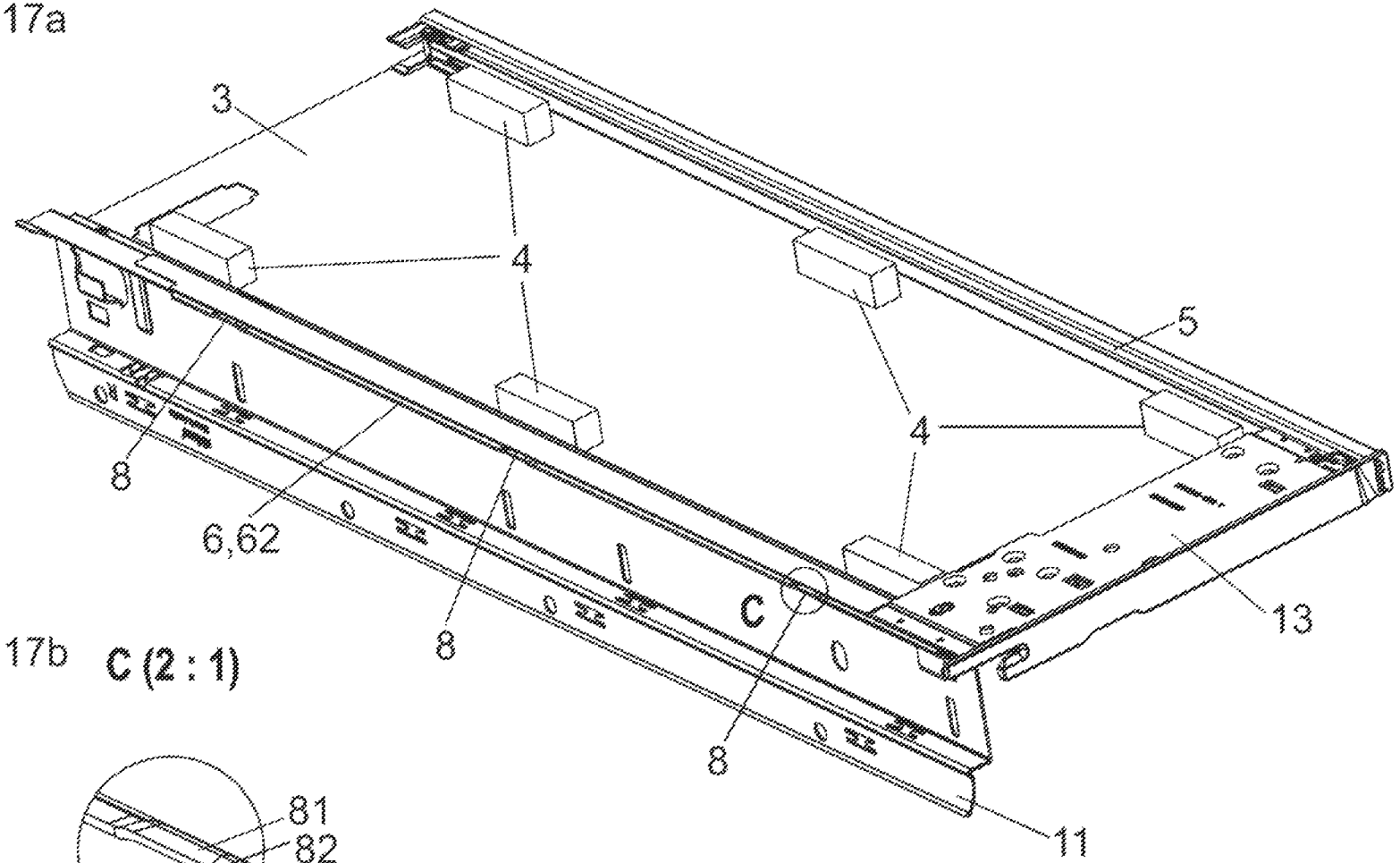
Fig. 17a
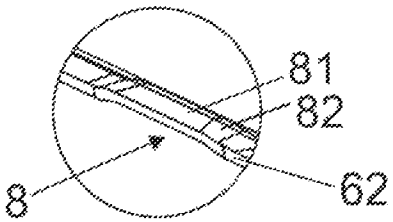
Fig. 17b C (2 : 1)

METHOD FOR PRODUCING A DOUBLE-WALLED DRAWER FRAME BY HAND AND/OR BY MACHINE

BACKGROUND OF THE INVENTION

The invention relates to a method for producing, by machine and/or by hand, a double-walled drawer frame for a drawer consisting of an inner wall and an outer wall. The invention furthermore relates to a double-walled drawer frame and a drawer.

Double-walled drawer frames are already known from the state of the art. These are usually produced in a mechanized process. The outer wall and the inner wall of the double-walled drawer frame are brought accordingly into position in this case and are joined to each other, for example welded, glued, riveted, screwed or clinched, using a suitable joining technique.

A disadvantage of the above-named joining techniques is that they are not suitable for the manual production of a double-walled drawer frame. In addition, in the case of a mechanized production process, an additional joining device that can realize the joining technique is necessary, for example a welding device, a gluing device, a riveting device, a screwing device and/or a clinching device.

A joining of the outer wall and the inner wall to each other can likewise be realized by means of mechanical holding devices, for example such as are disclosed in WO 2013/090951 A1. Double-walled drawer frames can thus be assembled by hand and/or by machine without additional devices.

A disadvantage of this state of the art is that the mechanical holding devices typically exhibit play, which can lead to rattling when the double-walled drawer frame is used.

SUMMARY OF THE INVENTION

The object of the present invention is to avoid, at least in part, the described disadvantages of the state of the art.

There is to be created an improved method for producing a double-walled drawer frame by machine and/or by hand, an improved double-walled drawer frame and an improved drawer. The double-walled drawer frame is to be capable of being produced by hand and/or by machine without additional joining devices. Moreover, rattling, for example between outer wall and inner wall, is to be avoided.

In a method according to the invention for producing, by machine and/or by hand, a double-walled drawer frame for a drawer consisting of an inner wall and an outer wall, the following method steps, in particular carried out chronologically in the order indicated, are provided:

- at least one spacer part is arranged on the inner wall and/or the outer wall, the two walls are arranged substantially parallel to each other,
- the two walls are displaced relative to each other in a direction parallel to a longitudinal direction of the walls and/or in a direction transverse to the longitudinal direction, and the two walls are joined to each other in the course of the displacement movement.

This constitutes a simple method for producing a double-walled drawer frame, wherein the method can be performed by hand and, if the method is performed by machine, no other joining devices are necessary. Rattling of the joined walls is prevented by the spacer parts.

In one embodiment, preferably the at least one spacer part is manufactured at least partly from an elastically compressible material.

At least one of the following additional method steps is provided:

- the at least one spacer part is elastically compressed,
- the at least one spacer part is compressed in that the two walls are arranged substantially parallel to each other.

The at least one spacer part is slightly overdimensioned, thus is larger than the distance between the outer wall and the inner wall.

Due to elastic compression of the at least one spacer part when arranging the walls, rattling of the outer wall on the inner wall is avoided, as the elastic counterforce of the at least one spacer part preloads the connection with play in one direction.

One embodiment has the following method step:

- the at least one spacer part is glued on the outer wall and/or on the inner wall.

The at least one spacer part is thus fixed on the outer wall and/or on the inner wall at a point provided for this. For example, this can simplify the manual production method, as the spacer part can thus not slip.

The at least one spacer part can be formed substantially cuboid-shaped. Preferably, at least one edge is flattened, particularly preferably in a direction parallel to a longitudinal direction of the walls.

In this case the following method step is provided:

- the at least one cuboid-shaped spacer part is glued on at least one lateral face on the outer wall and/or on the inner wall.

The lateral face of the cuboid-shaped spacer part constitutes a large and stable contact surface for bonding.

In one embodiment, the at least one spacer part has at least one slot, preferably wherein the opening of the at least one slot is widened in a V-shape and/or is arranged substantially in a direction parallel to a longitudinal direction of the walls.

The following method step is provided:

- the at least one spacer part is attached to the front side between outer wall and inner wall by the introduction of a longitudinal web located on the front side into the at least one slot.

The at least one spacer part can thus be fixed provisionally without bonding before the outer wall is applied to the inner wall. The V-shaped widening of the opening of the at least one slot makes the introduction of the longitudinal web located on the front side easier.

The double-walled drawer frame can have at least one guide device, wherein the at least one guide device comprises:

- at least one guide groove, and
- at least one guide web.

Moreover, at least one of the following method steps can be provided:

- the at least one guide web is arranged in the at least one guide groove, preferably by displacing the two walls relative to each other in a direction transverse to the longitudinal direction of the walls and/or preferably so that the at least one guide groove encompasses the at least one guide web,
- the at least one guide web is displaced in the at least one guide groove in a direction parallel to a longitudinal direction of the walls.

A guided displacement of the two walls in a direction parallel to a longitudinal direction of the walls is thus realized.

In one embodiment, the at least one guide groove and/or the at least one guide web have/has at least one substantially semicircular bend of a sheet metal part, preferably wherein the radius of the at least one bend of the at least one guide groove is greater than the radius of the at least one bend of the at least one guide web.

At least one of the following method steps is also provided:

- the at least one bend of the guide web is arranged in the at least one bend of the guide groove,
- the at least one bend of the guide web is displaced in the at least one bend of the guide groove.

The guide web and the guide groove can thus be produced easily and cost-effectively from a sheet metal part. A groove and a mating shape adapted to the groove can thus also be created easily.

The outer wall and/or the inner wall are manufactured from sheet metal, wherein:

- the at least one guide web is manufactured from the same sheet metal part as the outer wall, preferably from an end piece of the outer wall, and/or
- the at least one guide groove is manufactured from the same sheet metal part as the inner wall, preferably wherein the front side between outer wall and inner wall is manufactured from the same sheet metal part as the inner wall and wherein the at least one guide groove is arranged in the region of the front side.

The production of the guide web and the guide groove is thus, furthermore, designed in a simplified and cost-effective manner.

The double-walled drawer frame comprises at least one holding device for holding the at least one guide groove on the at least one guide web, and at least one of the following method steps is provided:

- the at least one guide web is pushed in the at least one guide groove into at least one first holding device, preferably wherein the at least one first holding device is arranged in a first end region of the at least one guide groove and/or is joined, fixed in place, to the at least one guide groove,
- at least one second holding device is affixed, preferably wherein the at least one second holding device is arranged in a second end region of the at least one guide groove and/or is formed as a separate component, in particular as a retaining clip.

The outer wall is held on the inner wall by the holding device. The double-walled drawer frame can thus be produced by hand or by machine without an additional device.

In one embodiment, the double-walled drawer frame has at least one mounting device, wherein the at least one mounting device comprises:

- at least one mounting groove, preferably wherein the at least one mounting groove is formed by a bent end piece of the outer wall, and
- at least one mounting web, preferably wherein the at least one mounting web is joined, fixed in place, to the inner wall.

The outer wall can thus be mounted in the inner wall.

Furthermore, at least one of the following method steps is provided:

- the at least one mounting web is arranged in the at least one mounting groove, preferably by displacing the two walls relative to each other in a direction transverse to the longitudinal direction of the walls and preferably so that the at least one mounting groove engages behind the at least one mounting web,
- the at least one mounting web is displaced in the at least one mounting groove in a direction parallel to a longitudinal direction of the walls.

The outer wall is thus displaced on the inner wall in the guide device and in the mounting device.

In one embodiment, the at least one mounting web comprises at least one play compensation device to compensate for play between the at least one mounting groove and the at least one mounting web, wherein the play compensation device widens the at least one mounting web, preferably wherein the at least one play compensation device is formed as at least one projection, particularly preferably wherein the at least one projection is formed flexible and/or has lateral flanks in ramp form.

The following method steps are provided:

- the at least one mounting web is wedged in the at least one mounting groove by the at least one play compensation device,
- the at least one play compensation device is compressed when the at least one mounting web is arranged in the at least one mounting groove.

Play in the mounting device is thus compensated for and rattling of the outer wall on the inner wall is avoided.

The double-walled drawer frame can have at least one guide device and at least one mounting device, wherein the guide device and the mounting device are arranged in the region of two opposing long sides of the outer wall and/or inner wall. The following method step is provided:

- the two walls are joined to each other on the two opposing long sides in the course of the displacement movement in a direction transverse to the longitudinal direction.

The outer wall is guided on two opposing long sides of the inner wall and then joined. The outer wall is thus stably joined to the inner wall.

A double-walled drawer frame according to the invention for a drawer comprising an inner wall and an outer wall can be produced by the method previously described. It is provided according to the invention that at least one spacer part can be arranged between the two walls, preferably wherein the at least one spacer part can be joined to the inner wall and to the outer wall.

Due to the arrangement of the at least one spacer part, rattling of the outer wall on the inner wall is avoided.

A drawer according to the invention comprises at least one double-walled drawer frame described above, preferably wherein the drawer has a drawer base, a rear wall and/or a front panel.

BRIEF DESCRIPTION OF THE DRAWINGS

Further details and advantages of the invention are explained in more detail below by means of the description of the figures with reference to the drawings, in which:

FIG. 17*a* is similar to FIG. 16*a* without outer wall represented, FIG. 17*b* shows a detail from FIG. 17*a* of the play compensation device.

DETAILED DESCRIPTION OF THE INVENTION

Figure 1:
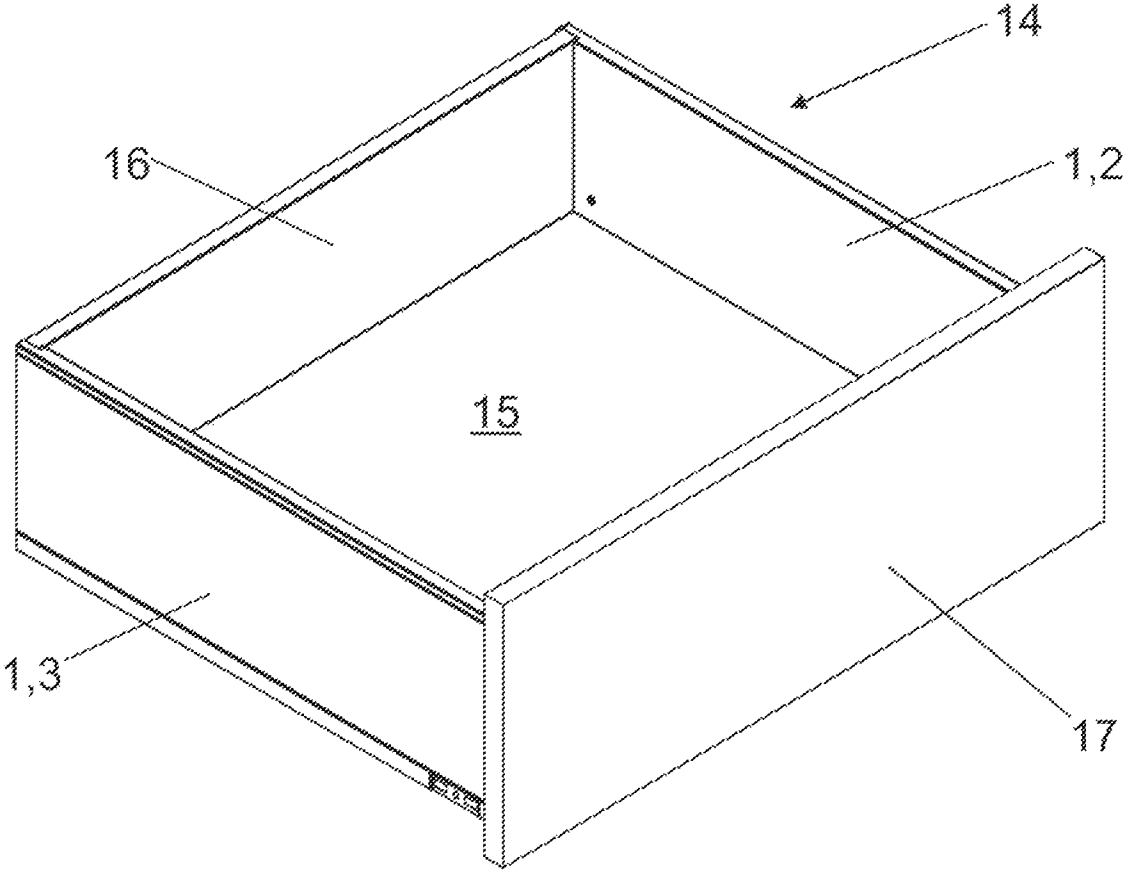
FIG. 1 shows a drawer with two double-walled drawer frames.

FIG. 1 shows a drawer 14 comprising two double-walled drawer frames 1, a drawer base 15, a rear wall 16 and a front panel 17. A double-walled drawer frame 1 is described in more detail below.

FIGS. 2*a-d* to FIGS. 11*a-d* show ten method steps of an embodiment of the method for producing a double-walled drawer frame by hand and/or by machine.

Figures 2A, 2B, 2C, 2D:
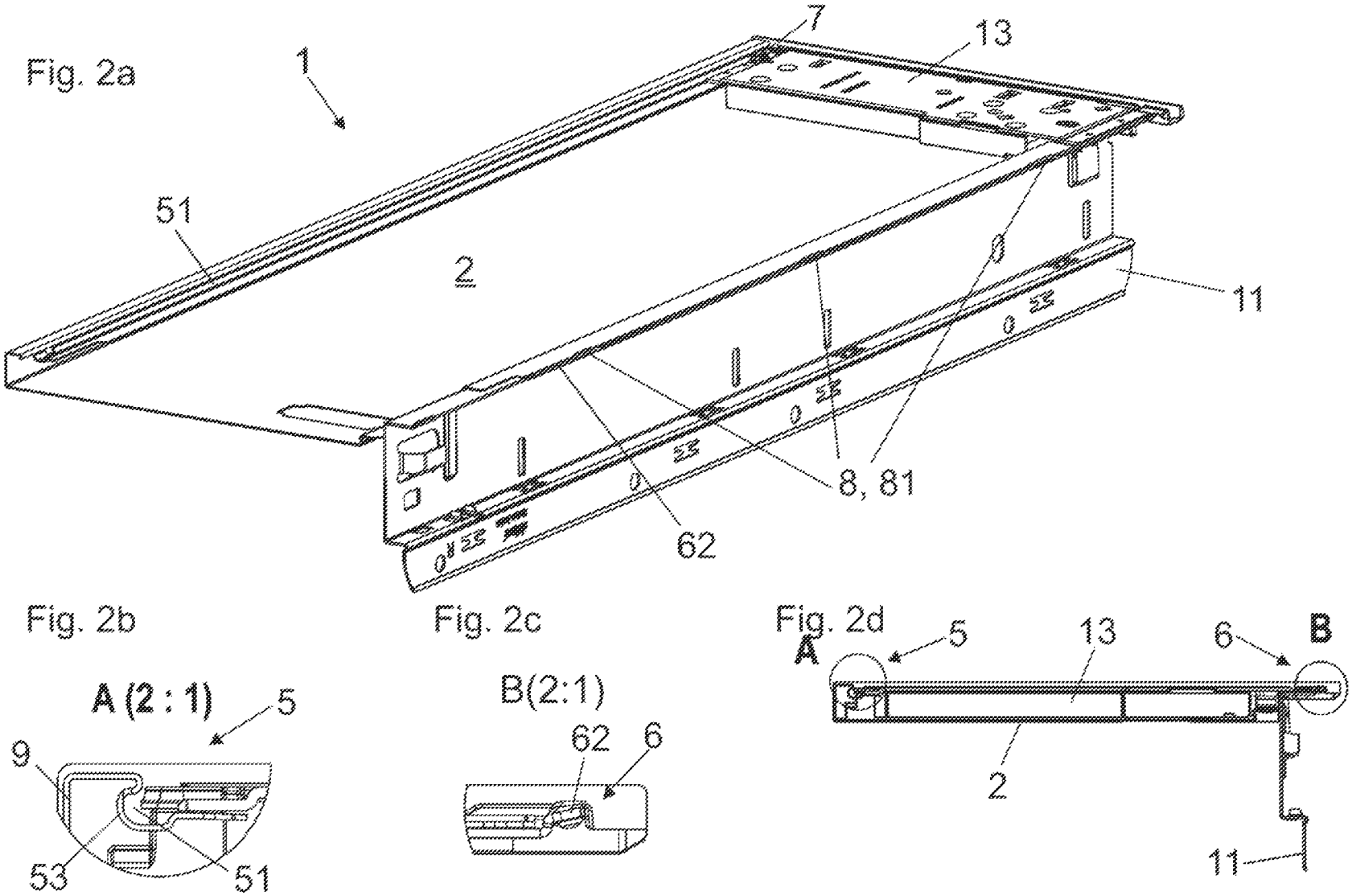
FIGS. 2*a* to 2*d* show a double-walled drawer frame without outer wall and without spacer parts, a. perspective view, b. cross-sectional detail of the guide device, c. cross-sectional detail of the mounting device, d. overall cross section.
Figure 3A:
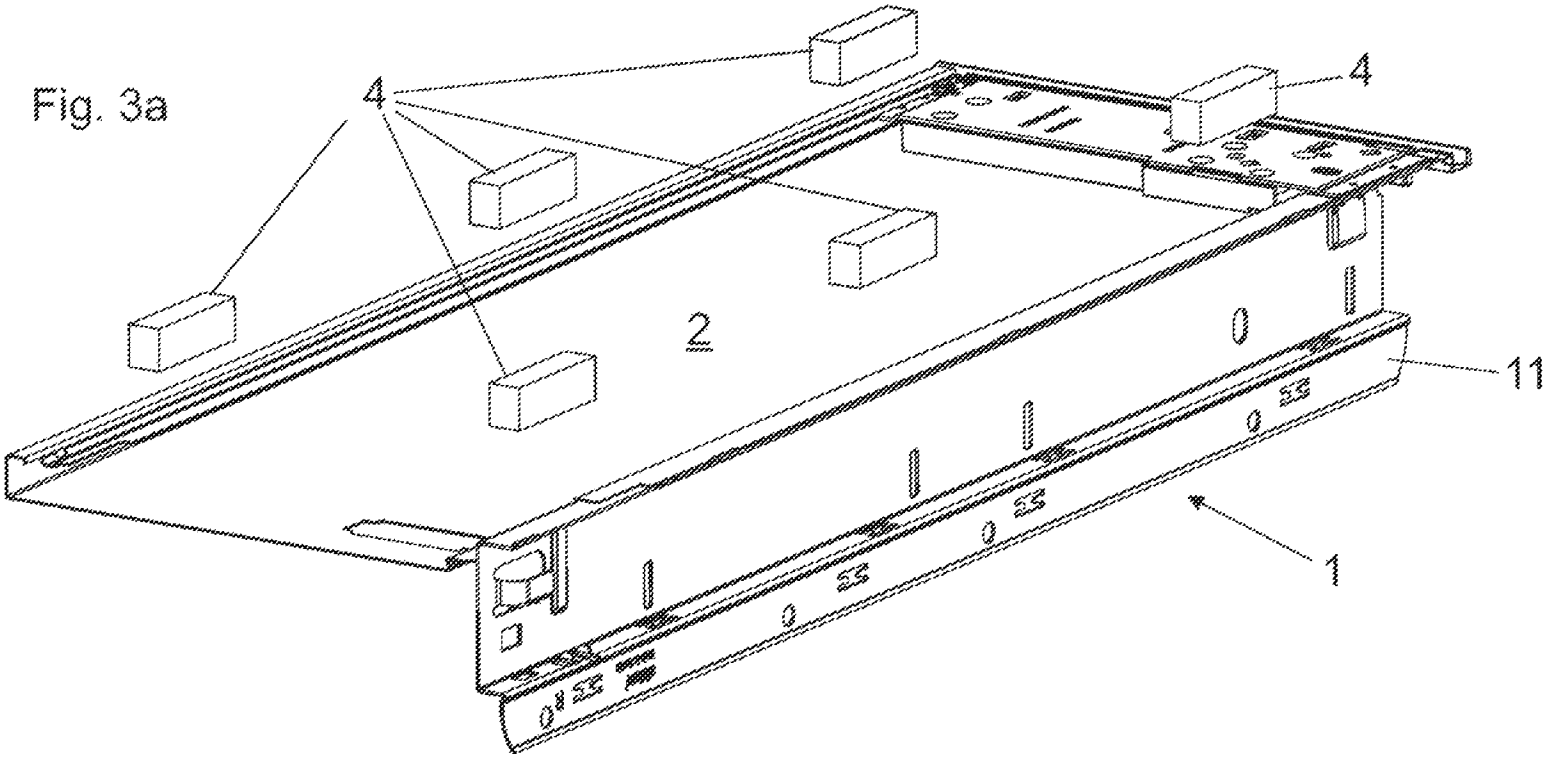
FIGS. 3*a* to 3*d* show a double-walled drawer frame with spacer parts provided without outer wall in the same views as in FIGS. 2*a* to 2*d*, FIGS. 4*a* to 4*d* show a double-walled drawer frame with spacer parts arranged on the inner wall without outer wall in the same views as in FIGS. 2*a* to 2*d*, FIGS. 5*a* to 5*d* show a double-walled drawer frame with outer wall provided in the same views as in FIGS. 2*a* to 2*d*, FIGS. 6*a* to 6*d* show a double-walled drawer frame with outer and inner wall arranged parallel to each other in the same views as in FIGS. 2*a* to 2*d*, FIGS. 7*a* to 7*d* show a double-walled drawer frame with lowered outer wall in the same views as in FIGS. 2*a* to 2*d*, FIGS. 8*a* to 8*d* show a double-walled drawer frame following displacement of the two walls relative to each other in a direction transverse to the longitudinal direction in the same views as in FIGS. 2*a* to 2*d*, FIGS. 9*a* to 9*d* show a double-walled drawer frame following displacement of the two walls relative to each other in a direction parallel to the longitudinal direction in the same views as in FIGS. 2*a* to 2*d*, FIGS. 10*a* to 10*d* show a double-walled drawer frame with retaining clip provided in the same views as in FIGS. 2*a* to 2*d*, FIGS. 11*a* to 11*d* show a double-walled drawer frame with retaining clip affixed in the same views as in FIGS. 2*a* to 2*d*, FIGS. 12*a* to 12*d* show a double-walled drawer frame with retaining clip affixed without outer wall in the same views as in FIGS. 2*a* to 2*d*.
Figure 3D:
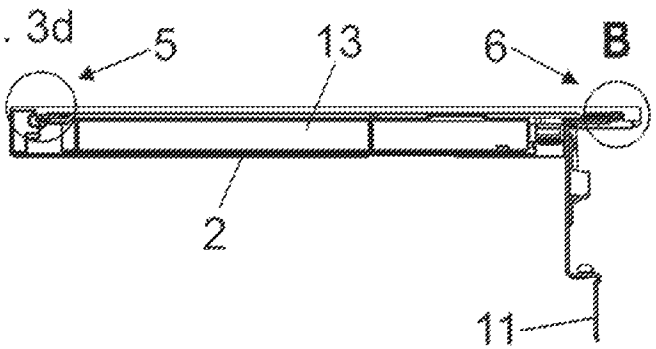
Figure 3C:
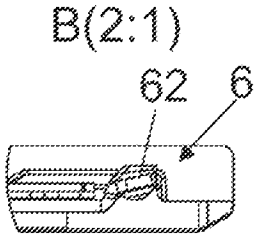
Figure 3B:
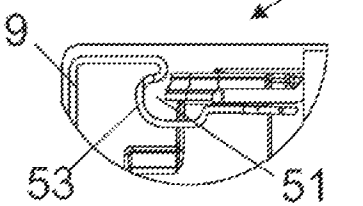
Figures 4A, 4B, 4C, 4D:
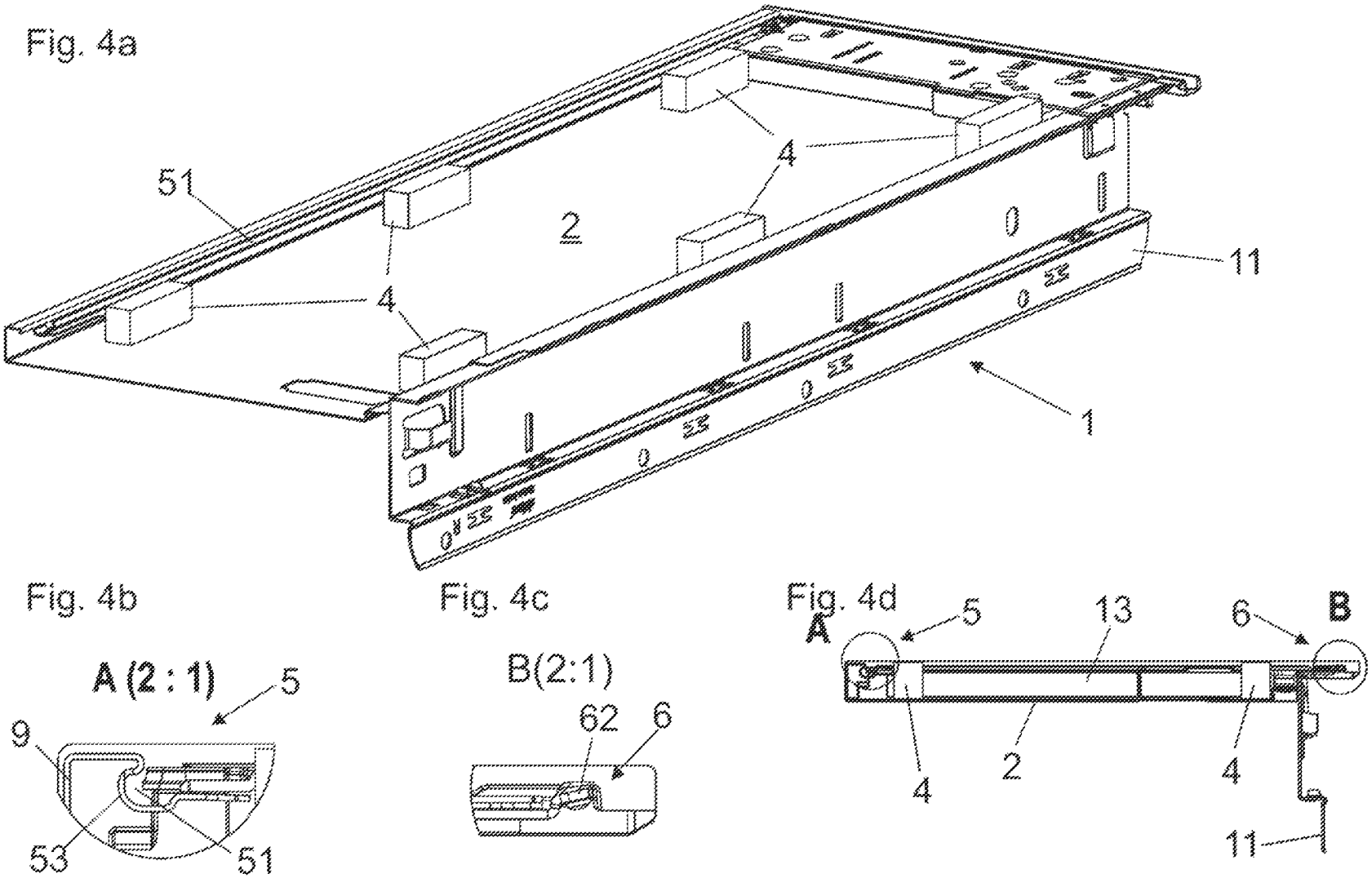
Figure 5A:
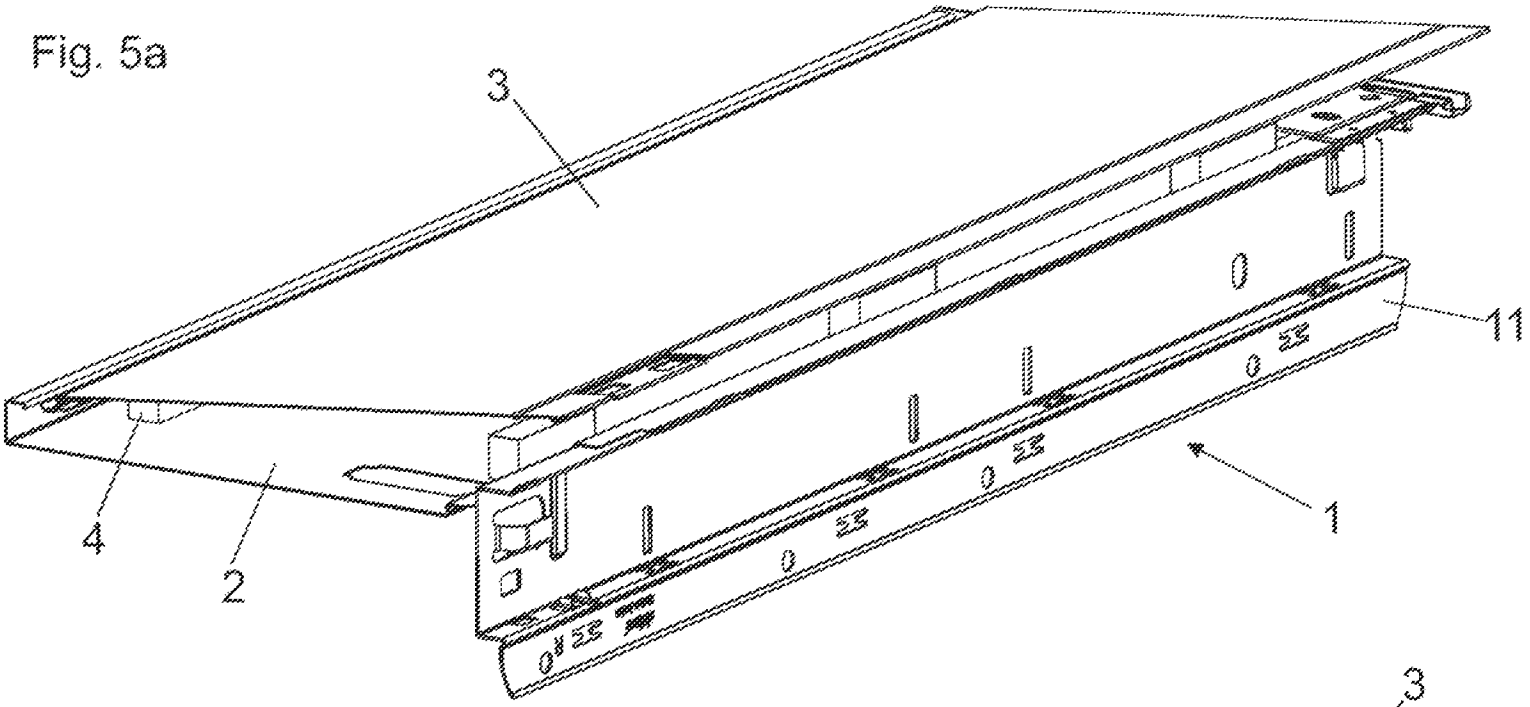
Figure 5D:
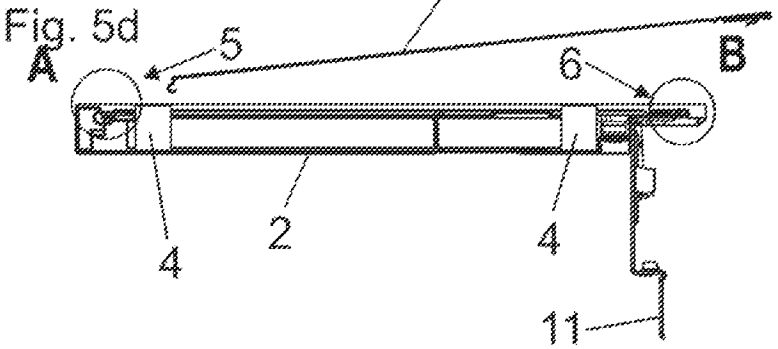
Figure 5C:
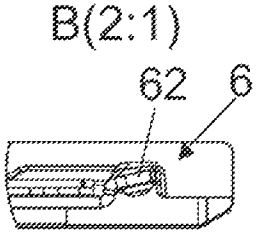
Figure 5B:
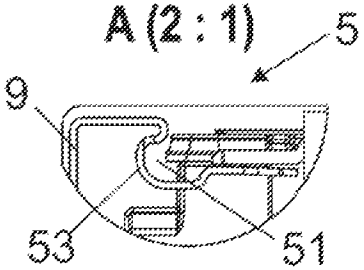

FIG. 2*a* shows an initial subject-matter of the method: an inner wall 2 is fixedly joined to a rear attachment 13 for attaching a rear wall 16 and to a container rail 11 for attaching a drawer base 15. Moreover, a front attachment 12 is provided for attaching a front panel 17, which is not shown here (for a representation see FIG. 19*a* and FIG. 20*a*). The joining of said parts can be realized by a known joining type such as screwing, welding or clinching.

FIG. 2*d* shows a cross section of FIG. 2*a*. The region indicated by a circle and the letter A is represented enlarged in FIG. 2*b*. The region indicated by a circle and the letter B is represented enlarged in FIG. 2*c*.

A part of a guide device 5 is visible from FIG. 2*b*. In particular, a guide groove 51 is visible, which is formed by at least one substantially semicircular bend 53 of a sheet metal part.

In the present embodiment, the inner wall 2 is manufactured from sheet metal. The front side 9 of the double-walled drawer frame 1 is formed from the same sheet metal part as the inner wall 2. The guide groove 51 is arranged in the region of the front side 9 and likewise formed from the same sheet metal part. As all said components are formed from the same sheet metal part, a considerable cost reduction is achieved.

Located at one end of the guide device 5 is a holding device 7 for holding an outer wall 3, which has not yet been affixed.

A part of the mounting device 6 is visible from FIG. 2*c*. In particular, a mounting web 61 62 is visible. The mounting web 62 consists of the end piece of a bent sheet metal part, which is affixed to the container rail 11. Arranged on the mounting web 62 is a play compensation device 8 in the form of projections 81.

The guide device 5 and the mounting device 6 are arranged in the region of two opposing long sides of the inner wall 2 (and/or the outer wall 3).

The remaining part of the guide device 5 and of the mounting device 6 are formed on the outer wall 3, as is visible in some of the following figures.

FIGS. 3*a-d* show, in addition to FIGS. 2*a-d*, six spacer parts 4, which have not yet been arranged. The six spacer parts 4 are formed substantially cuboid-shaped.

In FIGS. 4*a-d*, the spacer parts 4 are arranged on the inner wall 2. In particular, three spacer parts are arranged in the region of the guide device 5 and three spacer parts are arranged in the region of the mounting device 6.

The spacer parts 4 can be glued on the inner wall 2. These are thus fixed for the following affixing of the outer wall 3. In the case of cuboid-shaped spacer parts 4, the bonding is effected on a side wall 43 of the cuboid.

In FIGS. 5*a-d*, an outer wall 3 is provided. The outer wall 3 is preferably manufactured from sheet metal.

In FIGS. 6*a-d*, the outer wall 3 is arranged parallel to the inner wall 2.

Figure 6A:
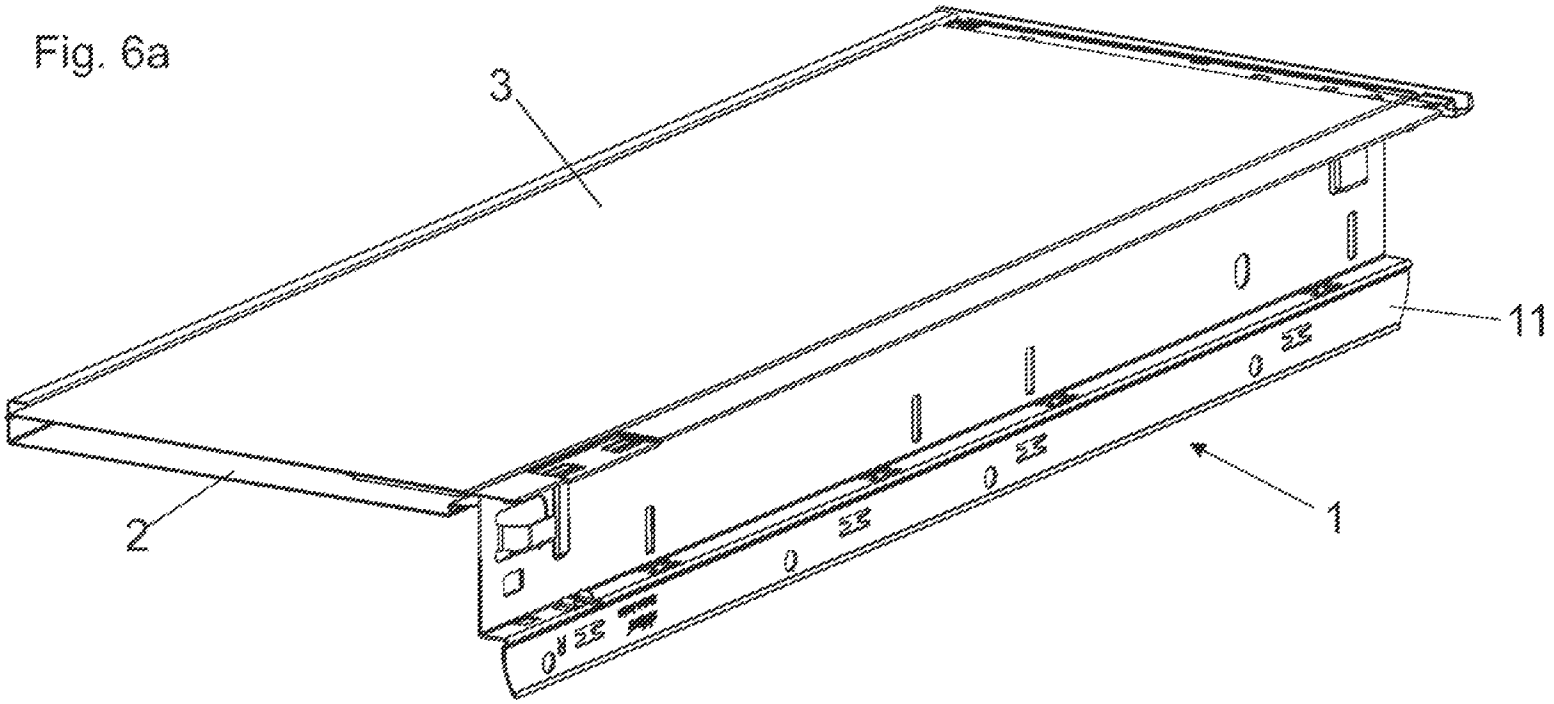
Figure 6B:
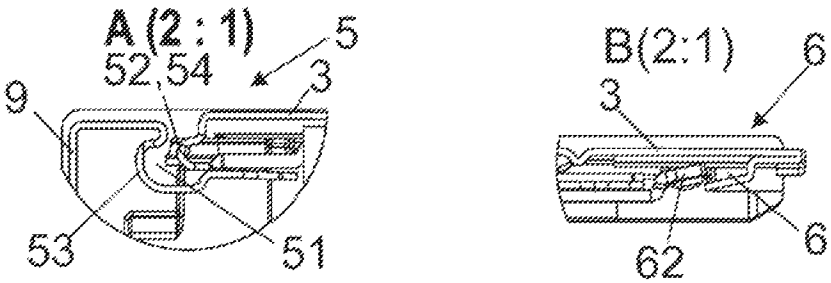

In FIG. 6*b*, the second part of the guide device 5, the guide web 52 located on the outer wall 3, is visible in addition to the guide groove 51.

The guide web 52 has a substantially semicircular bend 54 of a sheet metal part. Preferably, the radius of the at least one bend 53 of the at least one guide groove 51 is greater than the radius of the at least one bend 54 of the at least one guide web 52. The bend 54 of the guide web thus fits into the bend 53 of the guide groove 51. These are not yet arranged in each other in FIG. 6*b*, however.

The outer shape of the guide web 52 substantially corresponds to the inner shape of the guide groove 51.

The at least one guide web 52 is manufactured from the same sheet metal part as the outer wall 3, preferably from an end piece of the outer wall 3. Material and production costs are saved in this way.

Figure 6C:
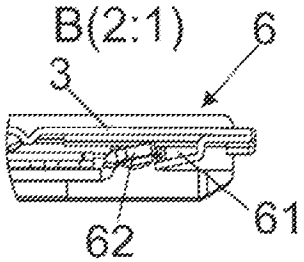
Figure 6D:
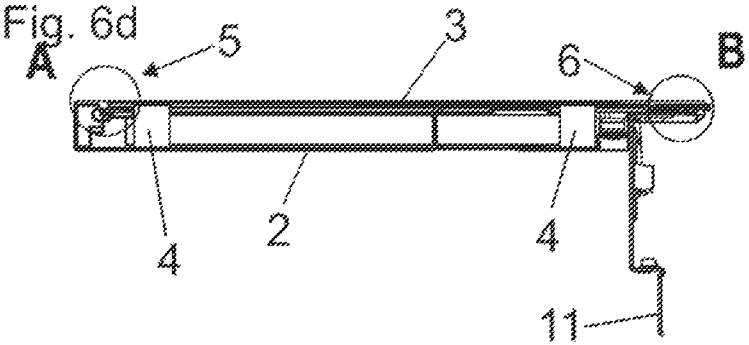

In FIG. 6*c*, the second part of the mounting device 6, the mounting groove 61 located on the outer wall 3, is visible in addition to the mounting web 62. The one mounting groove 61 is formed by a bent end piece of the outer wall 3.

In FIGS. 7*a-d*, the outer wall 3 is brought closer to the inner wall 2 in parallel. The distance between the outer wall 3 and the inner wall 2 thus assumes its value in the assembly position.

Figure 7A:
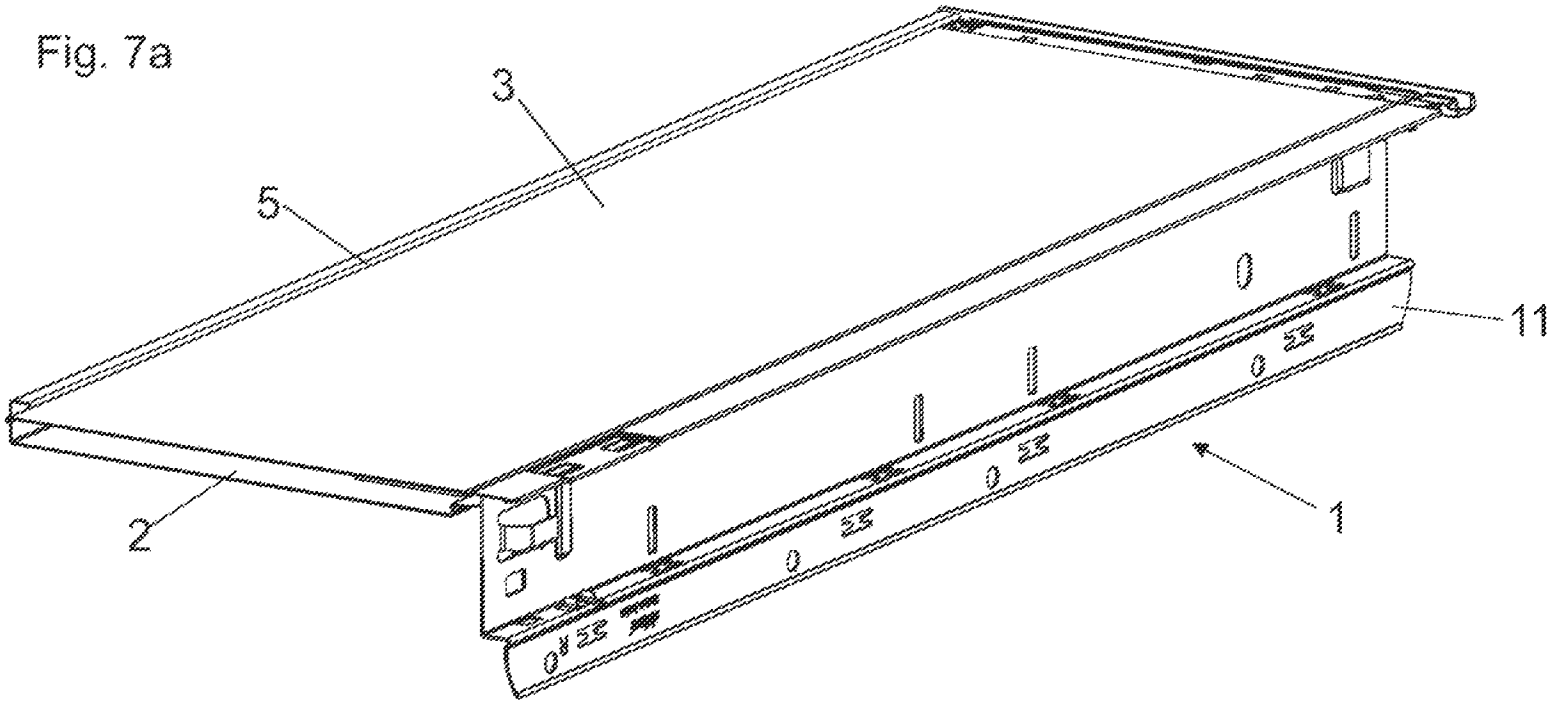
Figure 7C:
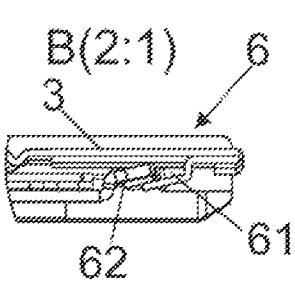
Figure 7B:
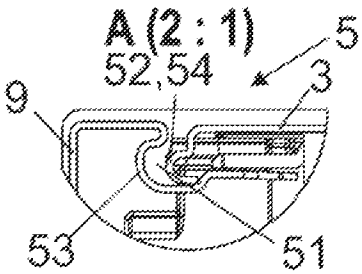
Figure 7D:
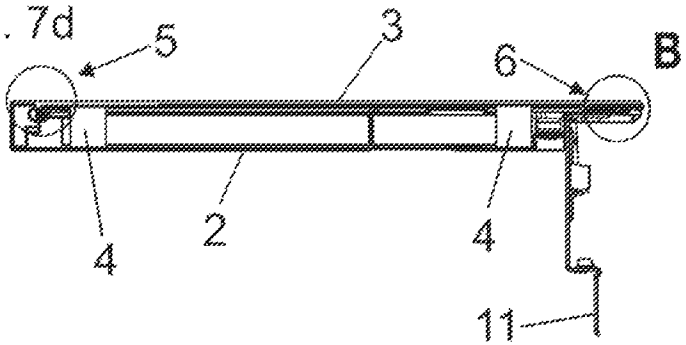
Figure 8A:
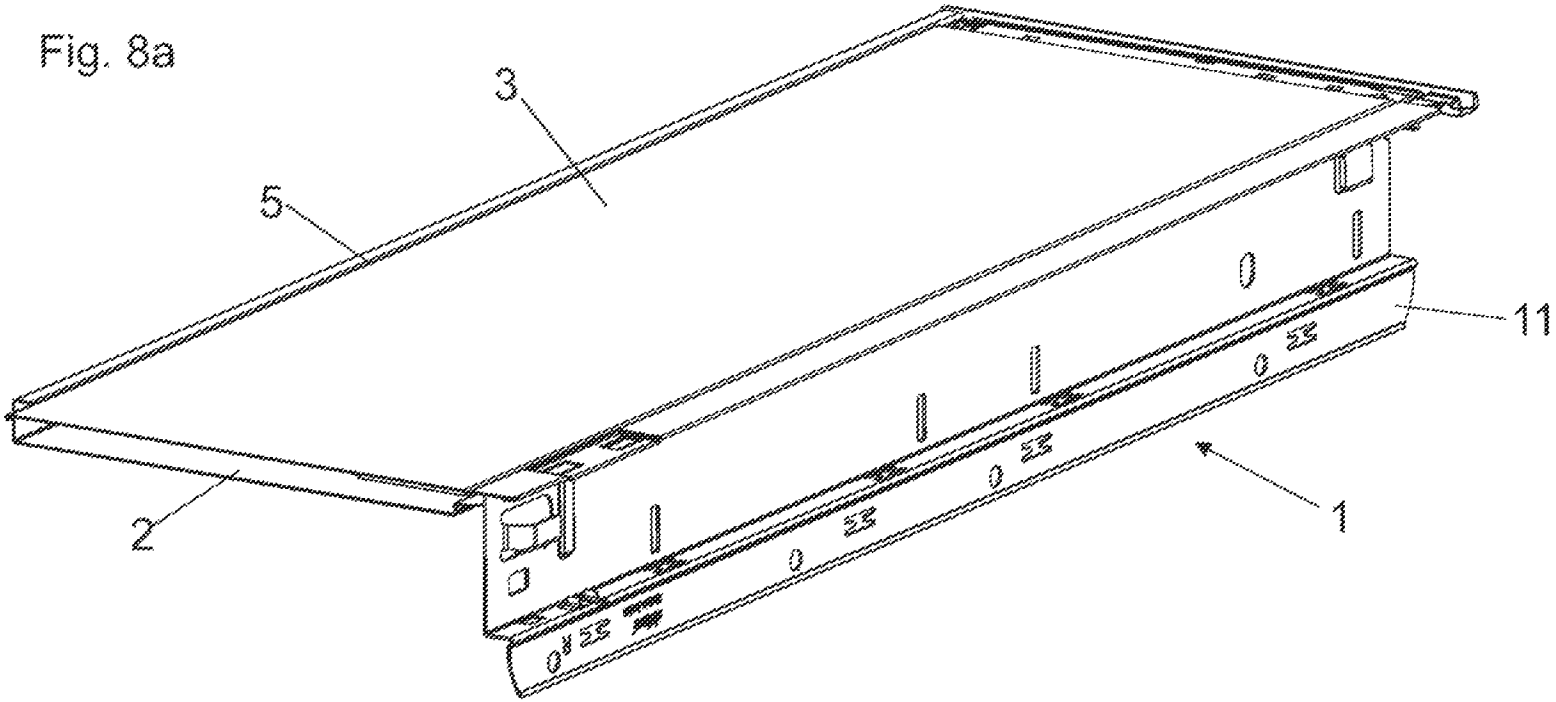
Figure 8D:
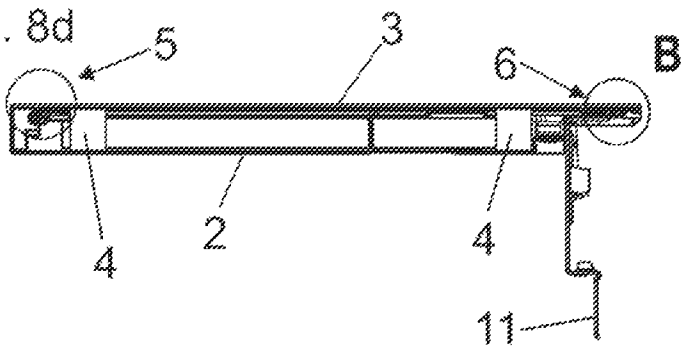
Figure 8C:
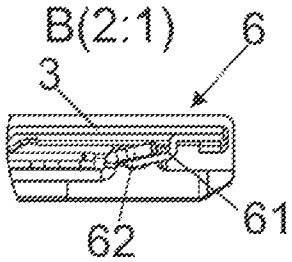
Figure 8B:
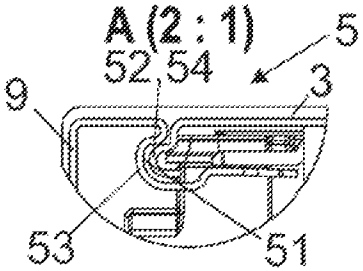
Figure 9A:
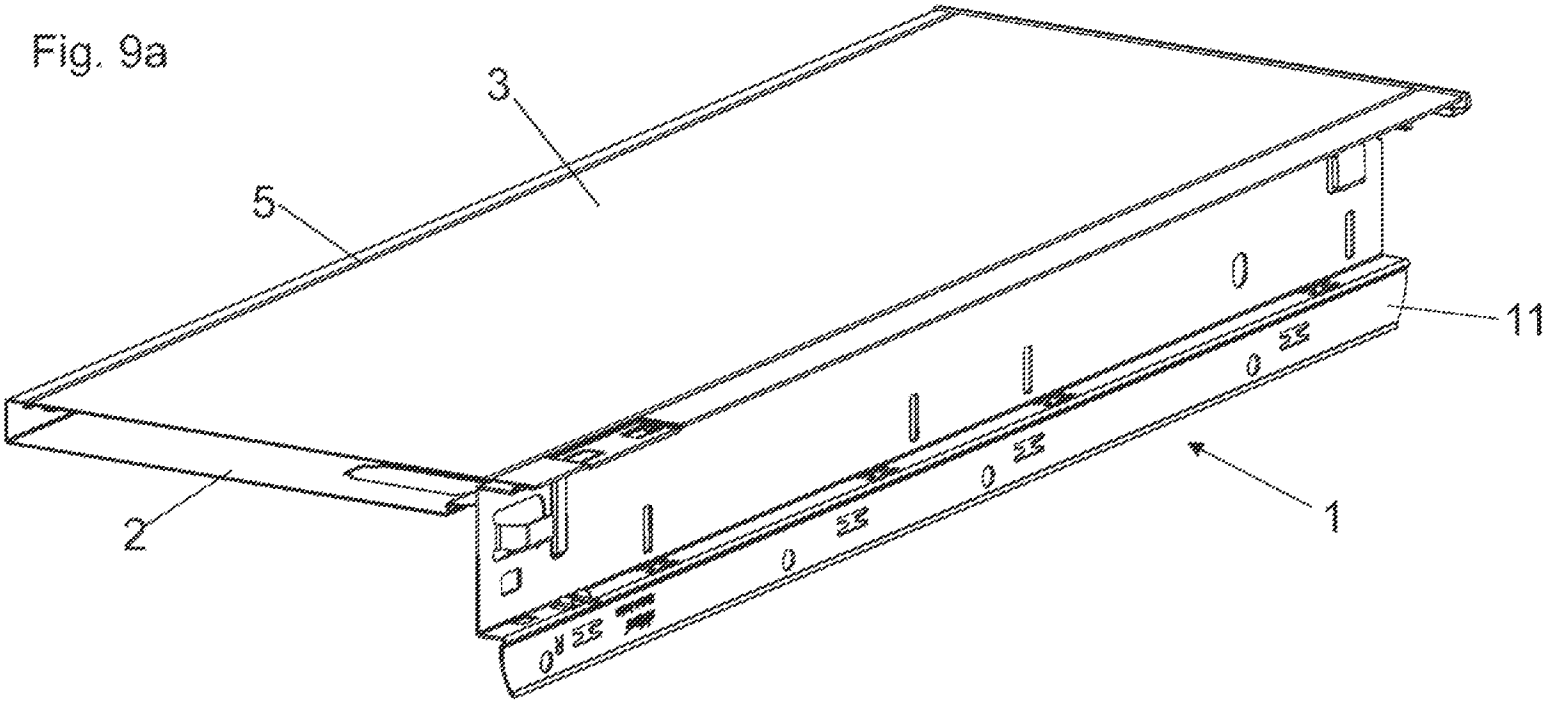
Figure 9D:
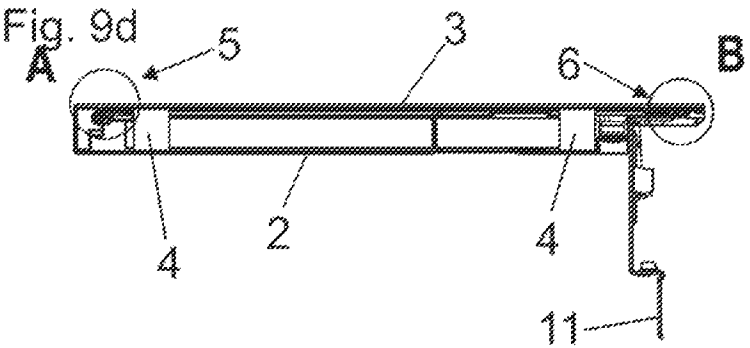
Figure 9C:
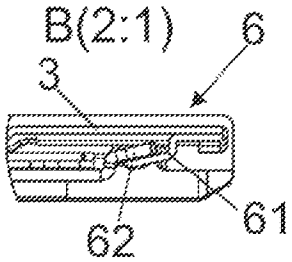
Figure 9B:
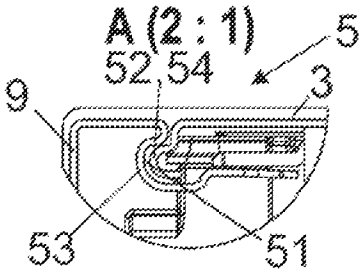
Figures 10A, 10B, 10C, 10D:
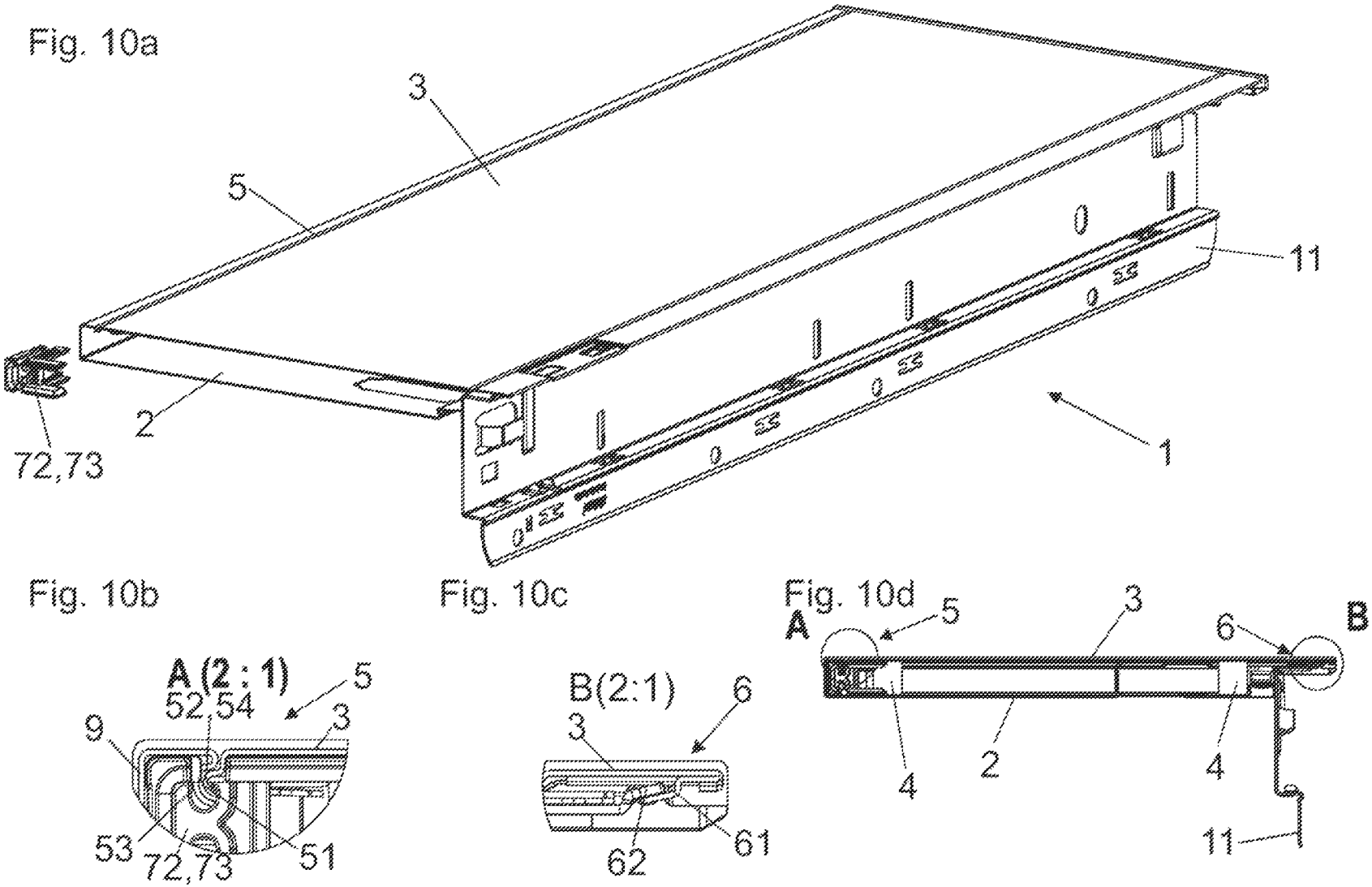
Figure 11A:
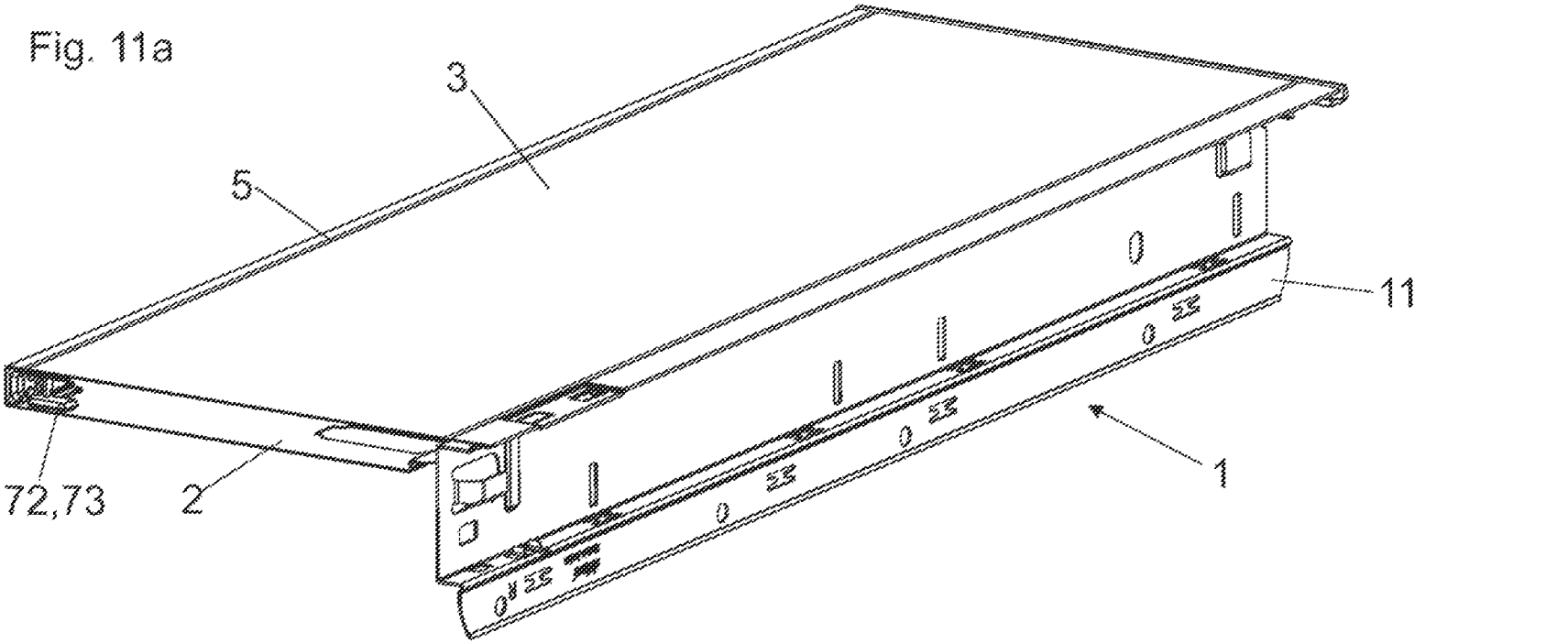
Figure 11D:
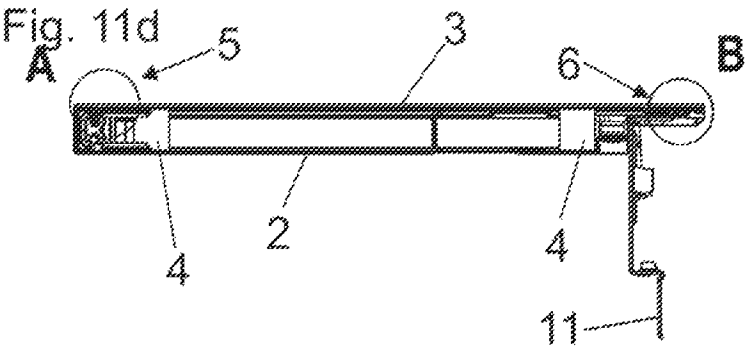
Figure 11C:
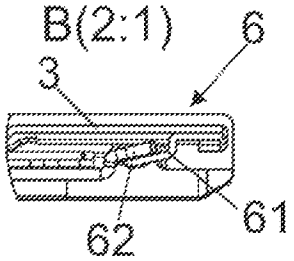
Figure 11B:
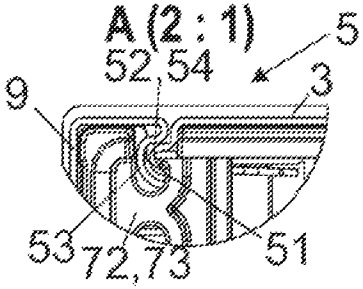

In FIGS. 7*a-d*, the outer wall 3 is likewise displaced a little transverse to a longitudinal direction of the walls 2, 3, so that the mounting web 62 is introduced (not completely) into the mounting groove 61 (see FIG. 7*c*).

By bringing the two walls 2, 3 closer together, the spacer parts 4 are elastically compressed. To this end the spacer parts 4 can be manufactured at least partly from an elastically compressible material. Due to the elasticity of the spacer parts 4, the outer wall 3 and the inner wall 2 are pressed apart from each other. Any play in the guide device 5 is thus compensated for in the assembled state by preloading in one direction. Rattling of the outer wall 3 on the rear attachment 13 is also avoided.

In FIGS. 8*a-d*, the outer wall 3 is displaced relative to the inner wall 2 transverse to a longitudinal direction of the walls 2, 3.

The guide web 52 is arranged in the guide groove 51 so that the at least one guide groove 51 encompasses the at least one guide web 52.

The at least one bend 54 of the guide web 52 is arranged in the at least one bend 53 of the guide groove 51. Here the bends 53, 54 of the guide groove 51 and the guide web 52, respectively, can rest against each other.

The mounting web 62 is arranged in the mounting groove 61 so that the at least one mounting groove 61 engages behind the at least one mounting web 62. The outer wall 3 is secured in this way against lifting off on the side of the mounting device 6.

The two walls 2, 3 are joined to each other on the two opposing long sides in the course of the displacement movement in a direction transverse to the longitudinal direction, as the guide device lies opposite the mounting device 6.

In FIGS. 9*a*-9*d*, the two walls 2, 3 are displaced relative to each other in a direction parallel to a longitudinal direction of the walls 2, 3.

Here, the guide web 52 is displaced in the at least one guide groove 51 in a direction parallel to a longitudinal direction of the walls 2, 3. More precisely, the at least one bend 54 of the guide web 52 is displaced in the at least one bend 53 of the guide groove 51.

The mounting web 62 is displaced in the at least one mounting groove 61 in a direction parallel to a longitudinal direction of the walls 2, 3.

The double-walled drawer frame has at least one holding device 7 for holding the at least one guide groove 51 on the at least one guide web 52. In the course of the displacement in a direction parallel to a longitudinal direction of the walls 2, 3, the at least one guide web 52 is pushed in the at least one guide groove 51 into at least one first holding device 71. The first holding device 71 is located in a first end region of the guide device 5. This is not visible in FIGS. 9*a-d*, but is shown below in FIG. 12*a* and in particular in FIG. 12*e*.

FIGS. 10*a-d* and 11*a-d* show the affixing of a retaining clip 73 as a second holding device 72. Here FIGS. 10*a-d* show a provided retaining clip 73 and FIGS. 11*a-d* a retaining clip 73 arranged on the double-walled drawer frame 1.

The second holding device 72 is arranged in a second end region of the at least one guide groove (51), wherein the second end region lies opposite the first end region.

In contrast to the first holding device 71, the second holding device 72 is formed as a separate component, in particular as a retaining clip 73.

The outer wall 3 is held on the long side of the guide device 5 by the affixing of the at least one holding device 7. Together with the mounting device 6 on the opposing side, the outer wall 3 is fixed against lifting off in this way.

At least one holding device 7 can wedge the guide groove 51 and the guide web 52 into a gap formed on the respective holding device 7. The gap on a second holding device 72 formed as a retaining clip 73 can be formed by two limbs.

In at least one holding device 7, a rail 74, which is joined, fixed in place, to the guide groove 51 or the guide web 52, can hold the guide web 52 or the guide groove 51 respectively to the guide groove 51 or the guide web 53 respectively.

For example, due to the bend 53, 54 in the guide groove 51 and the guide web 52, the guide web 52 is held in the guide groove 51 by the holding device.

FIGS. 12*a-e* show the double-walled drawer frame 1 with retaining clip 73 arranged but without outer wall 3. With FIG. 12*e* another view is added here to the views in FIGS. 2*a-d* to 11*a-d*, which view shows a detail of the perspective view of the first holding device 71 at a first end of the guide device 5.

Figures 12A, 12B, 12C, 12D, 12E:
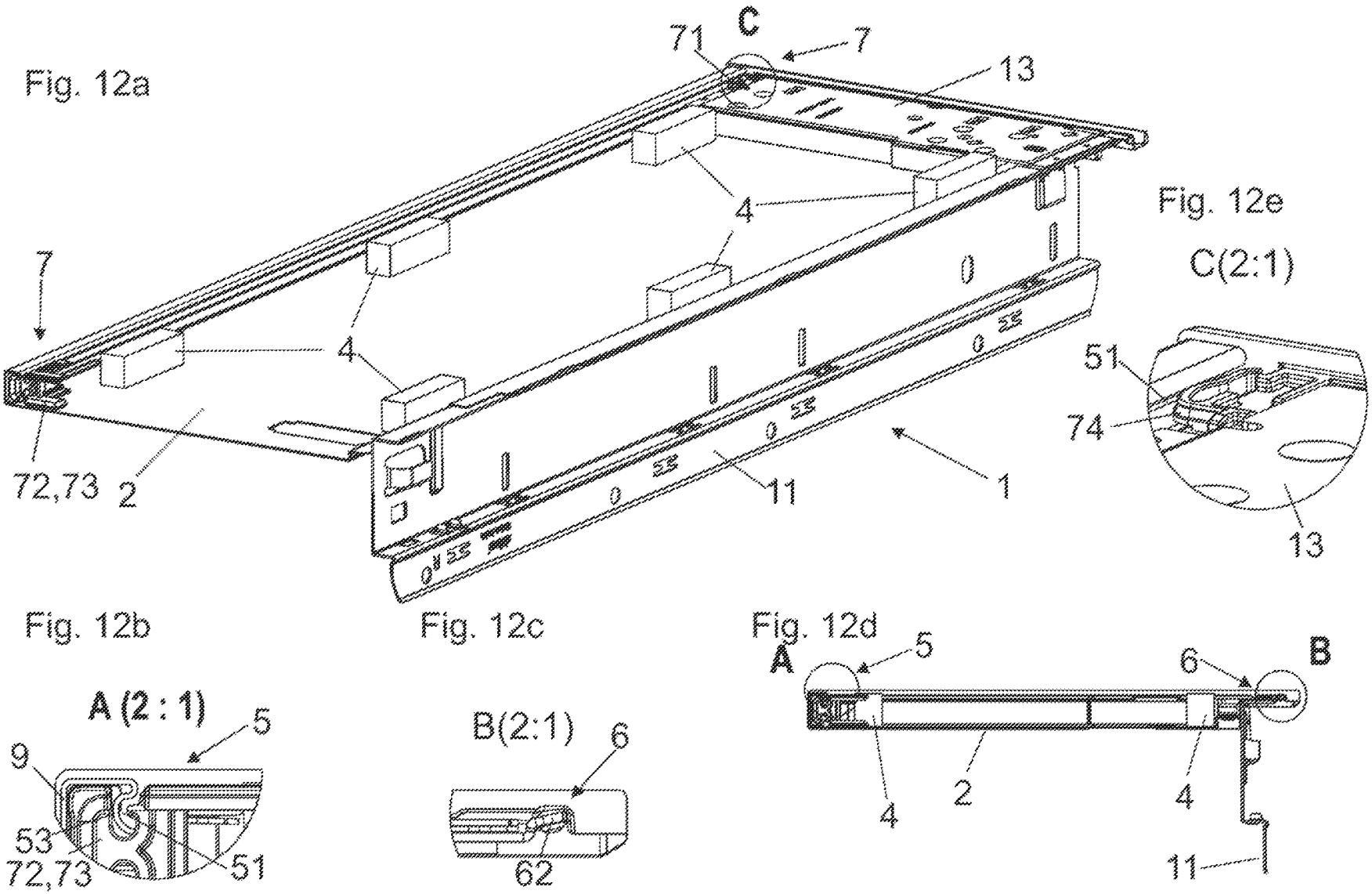
FIG. 12*e* is a detail from FIG. 12*a* of the first holding device.
Figures 13A, 13B, 13C, 13D, 13E:
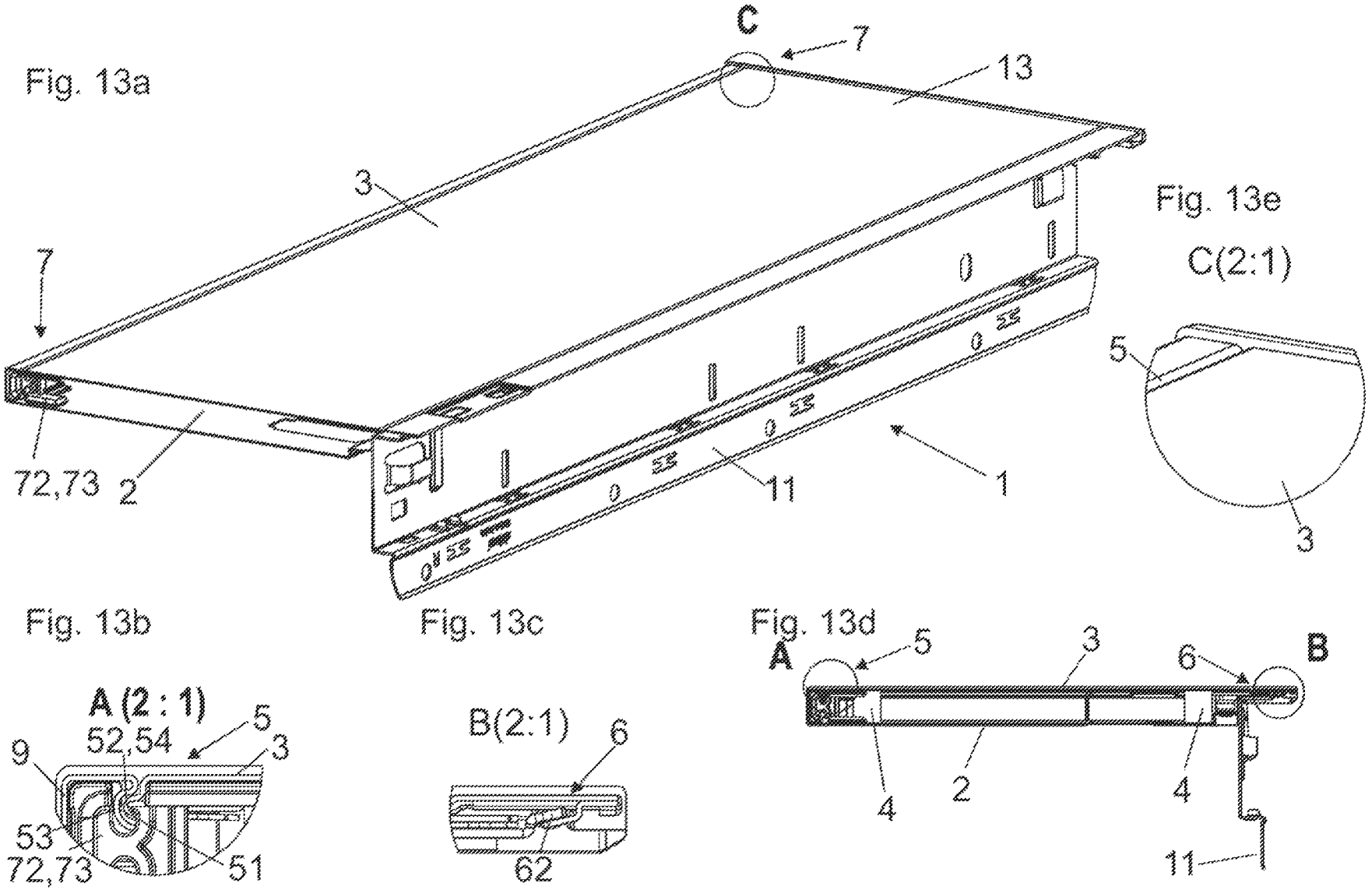
FIGS. 13*a* to 13*e* are similar to FIGS. 12*a* to 12*e* with outer wall represented, FIG. 14 show a double-walled drawer frame in an alternative perspective view.

It is clearly visible from FIG. 12*e* that the first holding device 71 is formed as a rail 74. The guide groove 51 and the rail 74 form a tight inlet which the guide web 52 (not represented, as part of the outer wall 3) enters by a movement of the outer wall 3 in a direction parallel to the longitudinal direction of the walls 2, 3. Due to the bends 53, 54 of the guide groove 51 and the guide web 52, the two components are held against each other.

The second holding device 72, which is formed as a retaining clip 73, is again visible from FIG. 12*b*. As described in the previous figures, this is affixed after the movement of the outer wall 3 in a direction parallel to the longitudinal direction of the walls 2, 3. The retaining clip 73 has at least two limbs, wherein the guide groove 51 and the guide web 52 (not represented, as part of the outer wall 3) are wedged in between the limbs.

It should be noted here that the configuration in FIGS. 12*a-e* is not provided in any method step, as the retaining clip 73 was affixed here before the outer wall 3. The omission of the outer wall 3 in FIGS. 12*a-e* serves for better visibility of the holding devices 7.

FIGS. 13*a-e* show the same views as FIGS. 12*a-e* with outer wall 3 already arranged.

Figure 14:
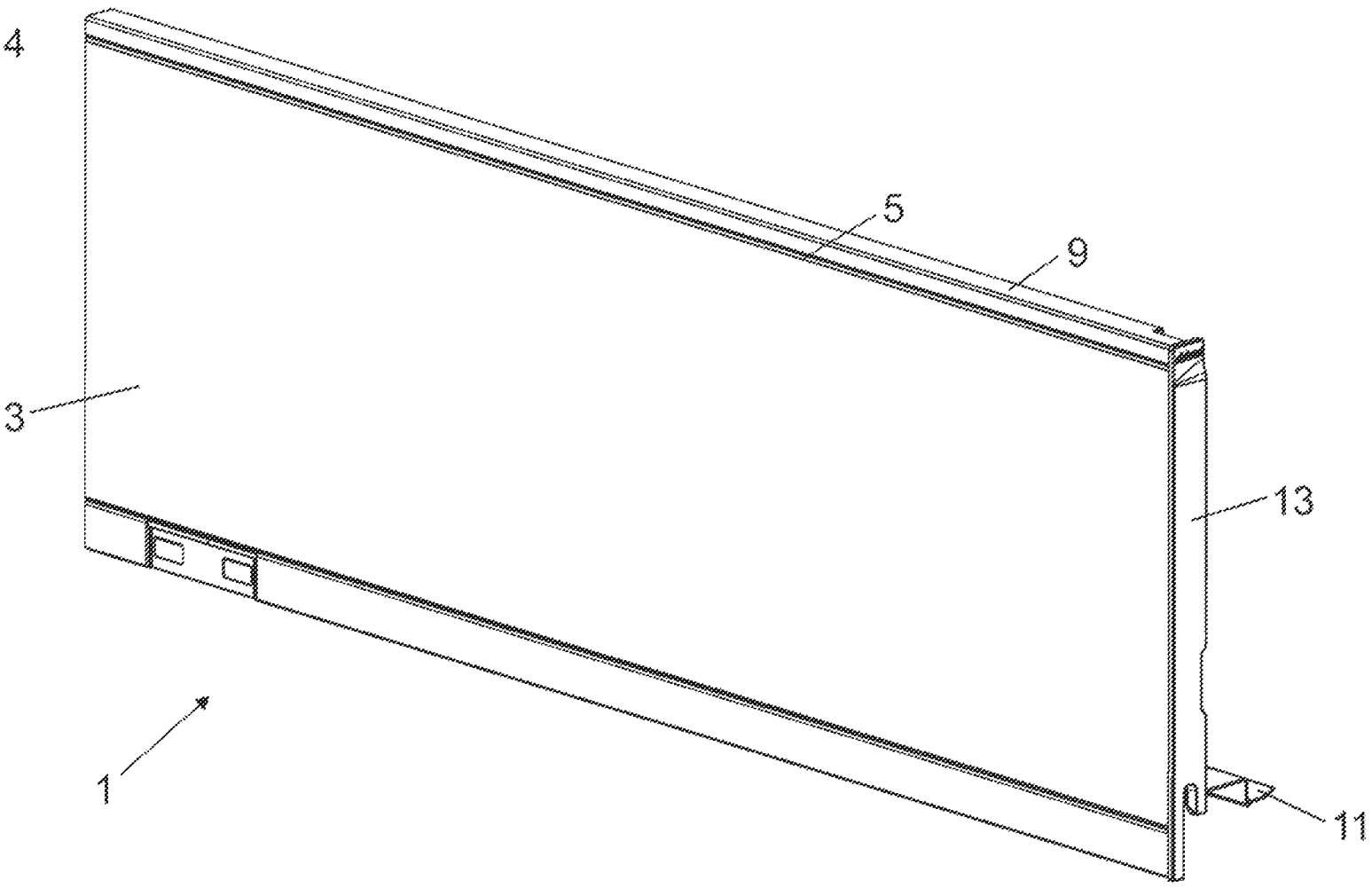

FIG. 14 shows an alternative perspective representation of the double-walled outer frame 1 in the ready-assembled state.

Figures 15A, 15B:
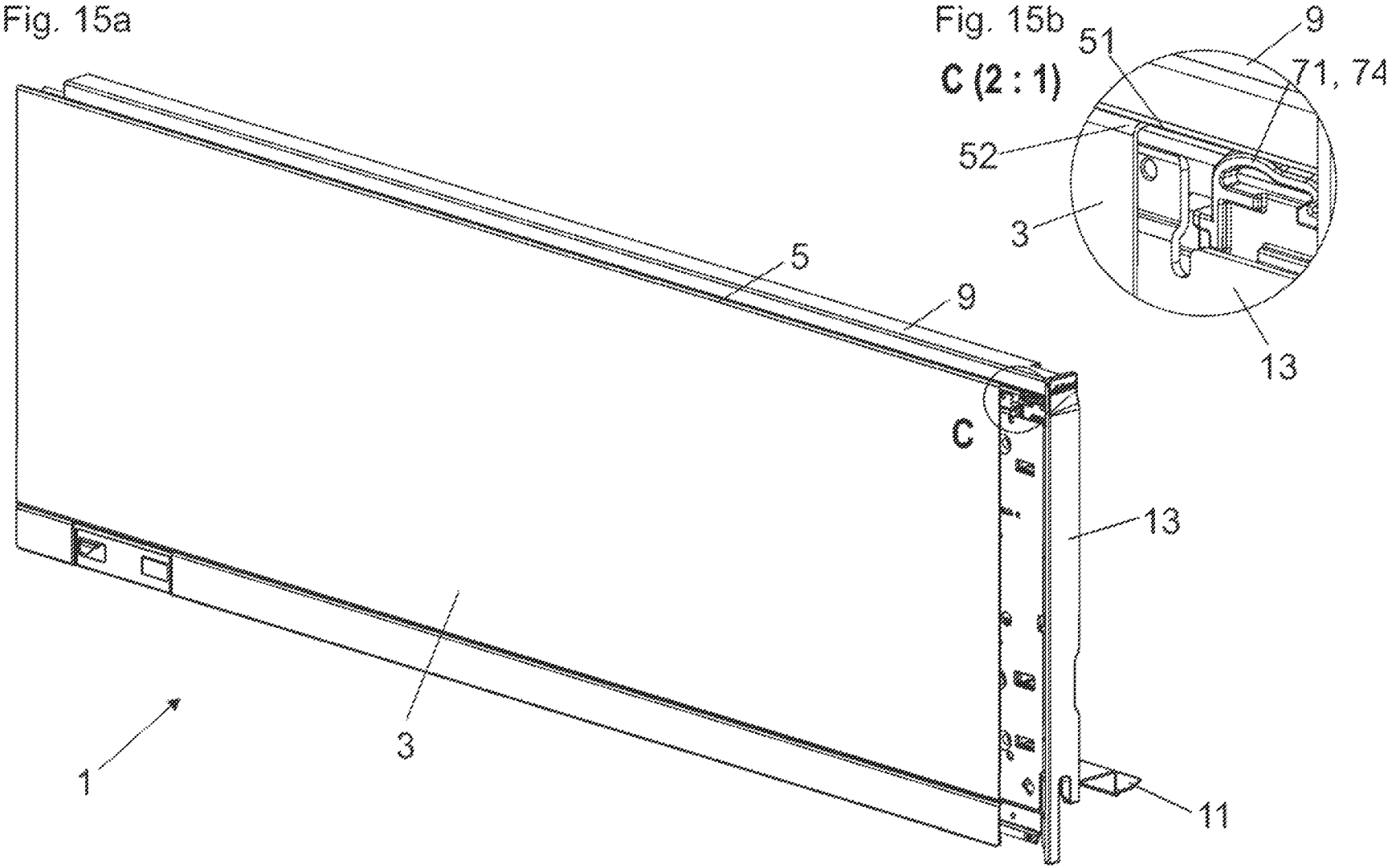
FIG. 15*a* is similar to FIG. 14 with outer wall displaced parallel to the longitudinal direction.
FIG. 15*b* is a detail from FIG. 15*a* of the first holding device.

FIGS. 15*a, b* show the same perspective as FIG. 14, wherein here the outer wall 3 has not yet been pushed in a direction parallel to the longitudinal direction of the walls 2, 3 in the ready-assembled state.

The first holding device 71 is thereby visible here, which is formed as a rail 74. A detailed view is shown in FIG. 15*b*.

Figures 16A, 16B:
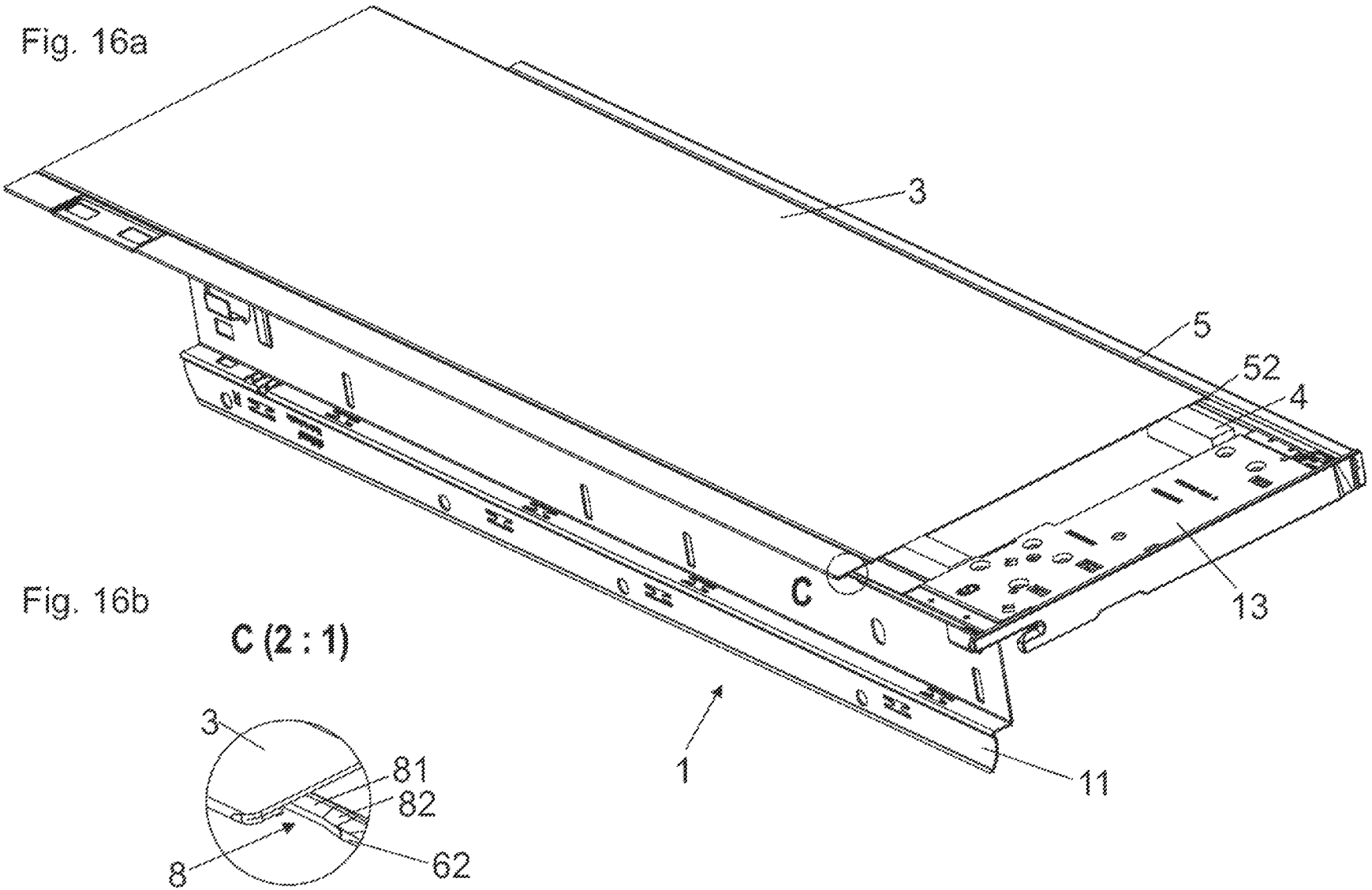
FIG. 16*a* is similar to FIG. 15*a* in an alternative perspective view.
FIG. 16*b* shows a detail from FIG. 16*a* of the play compensation device.

FIGS. 16*a, b* show a double-walled drawer frame 1 with outer wall 3 not yet displaced in a direction parallel to the longitudinal direction of the walls 2, 3.

A play compensation device 8 to compensate for play between the mounting groove 61 and the mounting web 62 is thereby visible here on the mounting device 6. This is represented enlarged by detail C in FIG. 16*b*.

Play between the mounting groove 61 and the mounting web 62 is compensated for by a widening on the mounting web 61. Here the play compensation device 8 is formed as a projection 81.

The projection 81 is preferably formed flexible and/or has lateral flanks 82 in ramp form.

The at least one mounting web 62 is wedged in the at least one mounting groove 61 by the play compensation device 8 and the play compensation device 8 can be compressed when the mounting web 62 is arranged in the mounting groove 61.

FIGS. 17*a, b* show the same view of the double-walled drawer frame 1 as FIGS. 16*a, b*, but without the outer wall 3. All spacer parts 4 are thereby visible.

Figure 18:
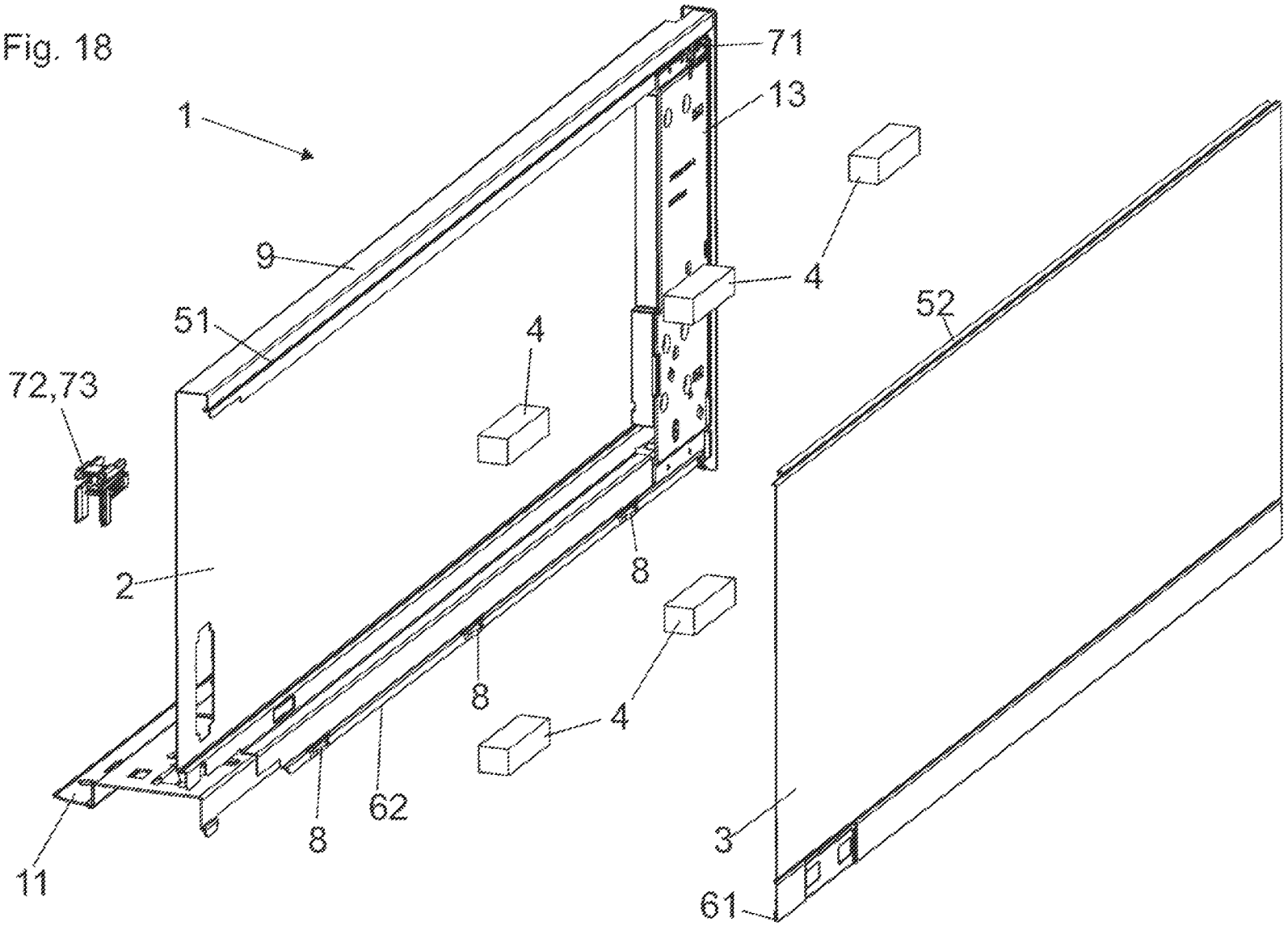
FIG. 18 is an exploded representation of the double-walled drawer frame.

FIG. 18 shows an exploded representation of the double-walled drawer frame 1. It is visible here that three play compensation devices 8 are provided, which are formed as projections 81. The six spacer parts 4 and the retaining clip 73 are also visible once again.

Figure 19A:
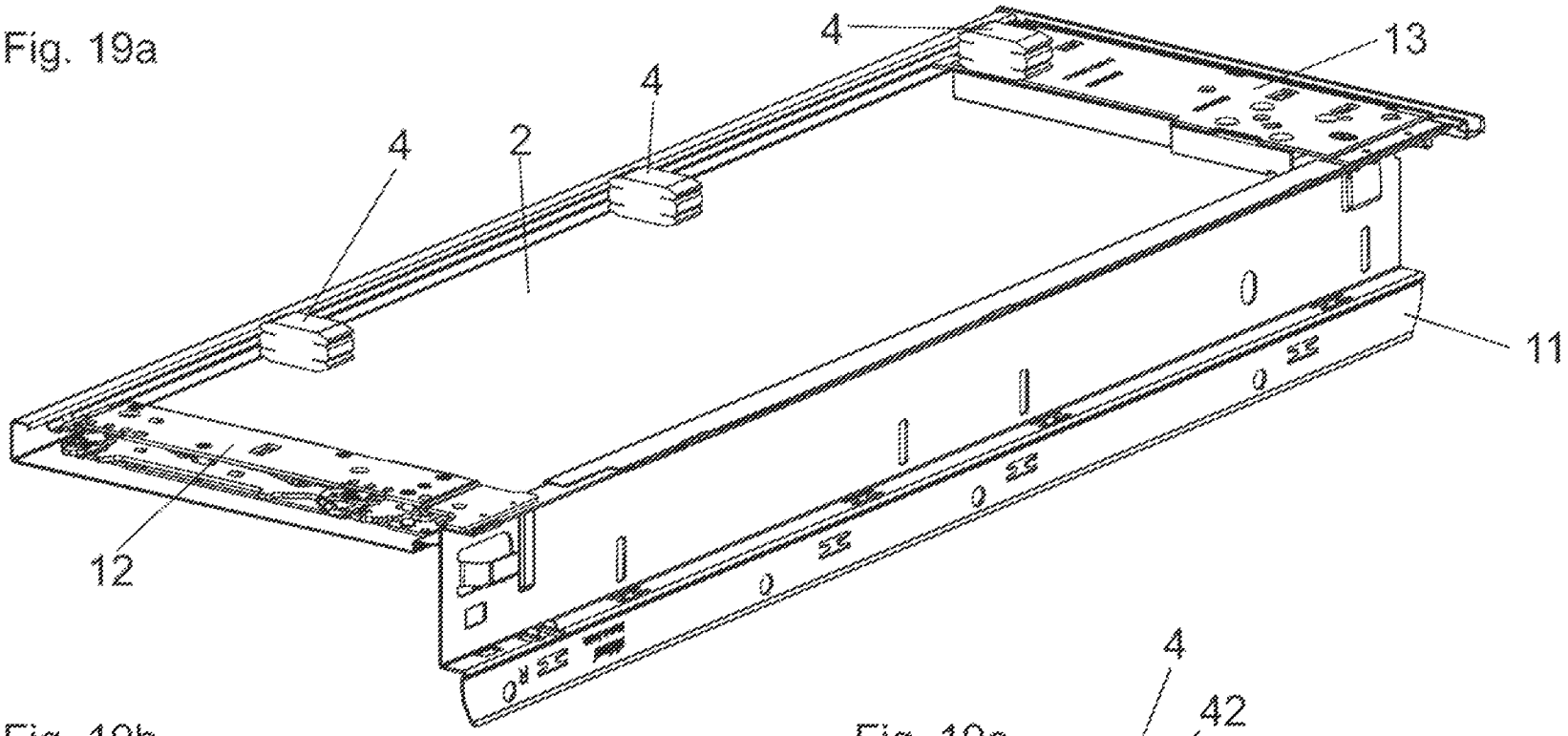
FIGS. 19*a* to 19*c* show a double-walled drawer frame with alternatively designed spacer parts with slots, a. perspective view, b. cross-sectional detail of the guide device, c. overall cross section.
Figure 19C:
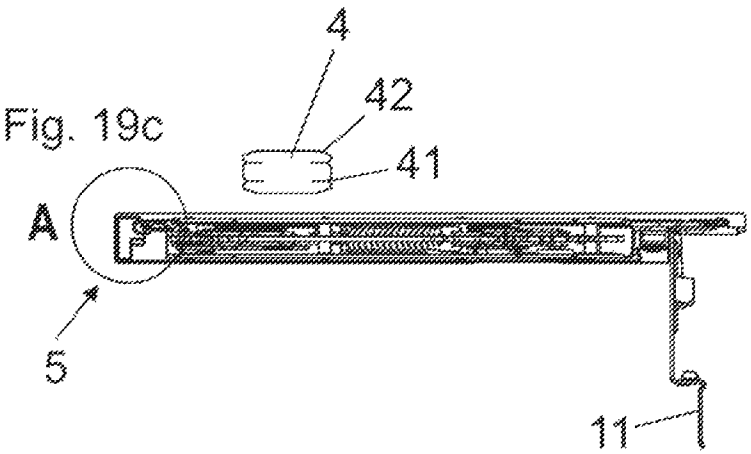
Figure 19B:
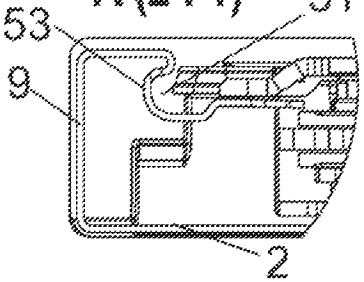

FIGS. 19*a-c* show a double-walled drawer frame 1 with alternatively designed spacer parts 4. In this case, FIG. 19*a* shows a perspective representation, FIG. 19*c* shows a cross section of FIG. 19*a*, and FIG. 19*b* shows a detail from the cross section of the region of the guide device 5.

In FIG. 19*a*, three spacer parts 4 are provided. The three spacer parts are designed substantially cuboid-shaped, wherein four edges 42 are flattened. The spacer parts 4 are arranged so that the four flattened edges 42 run in a direction parallel to a longitudinal direction of the walls 2, 3.

The spacer parts 4 have four slots 41. The openings of the slots 41 are widened in a V-shape and/or are arranged substantially in a direction parallel to a longitudinal direction of the walls 2, 3.

In FIG. 19*a*, the front attachment 12 for attaching a front panel 17 is also visible.

Figure 20A:
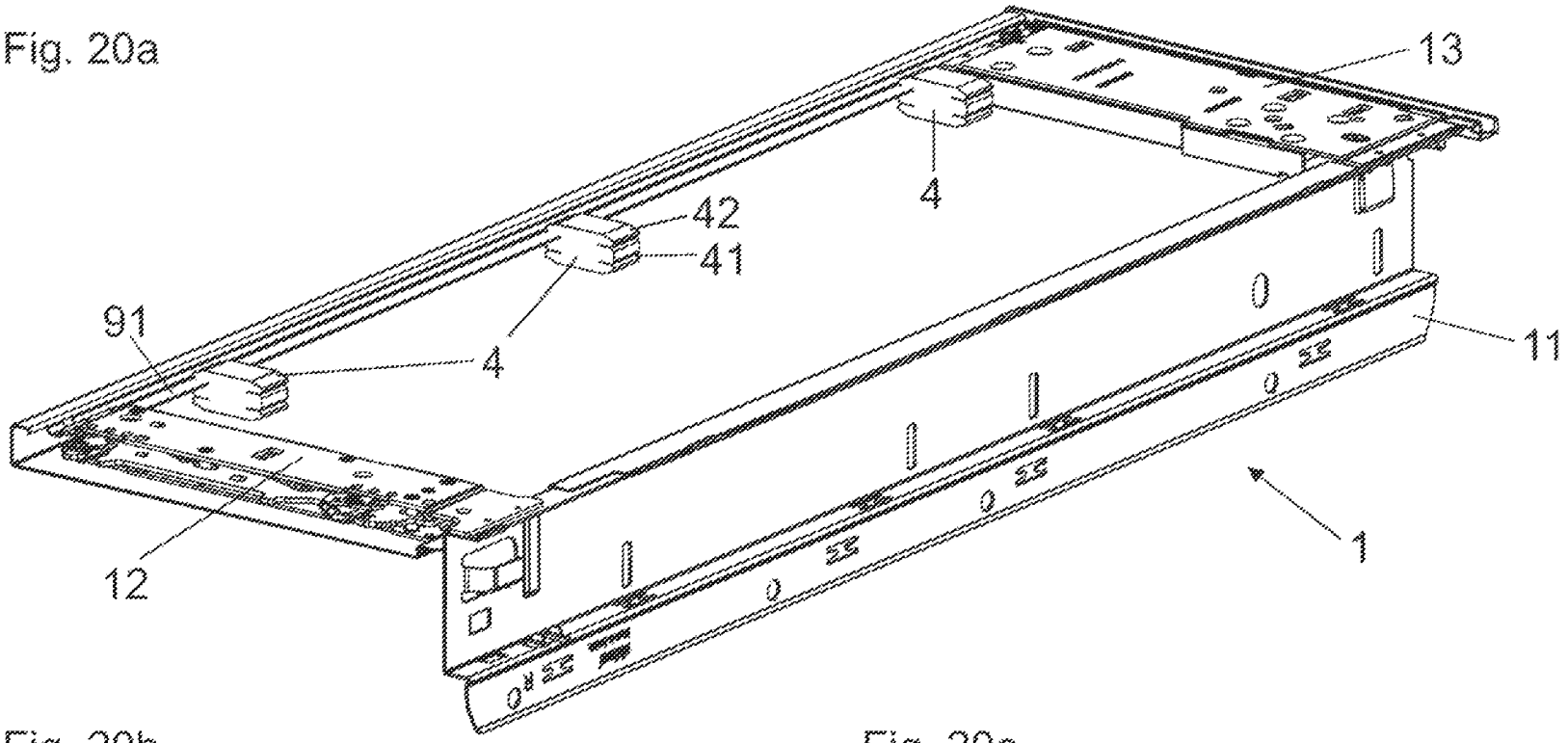
FIGS. 20*a* to 20*c* show a double-walled drawer frame with alternatively designed spacer parts arranged on the inner wall in the same views as in FIGS. 19*a* to 19*c*, FIGS. 21*a* to 21*c* show displacement movements of the outer wall in a top view.
Figure 20C:
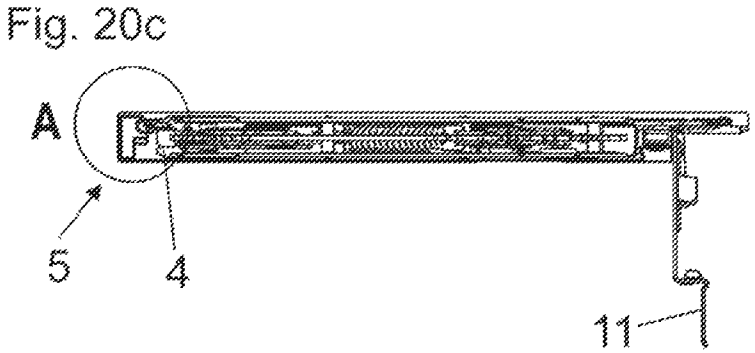
Figure 20B:
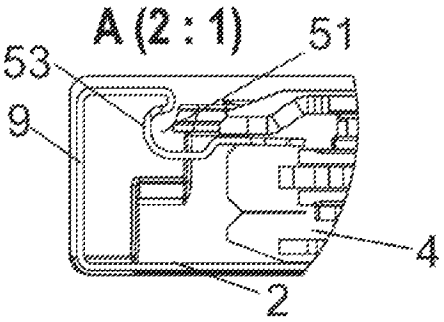

FIGS. 20*a-c* show spacer parts 4 already arranged on the inner wall 2. The spacer parts 4 are attached to the front side 9 between outer wall 3 and inner wall 2 by the introduction of a longitudinal web 91 located on the front side 9 into the at least one slot 41. This type of attachment renders bonding of the spacer parts 4 on the outer wall 3 and/or the inner wall 2 obsolete.

Figures 21A, 21B, 21C:
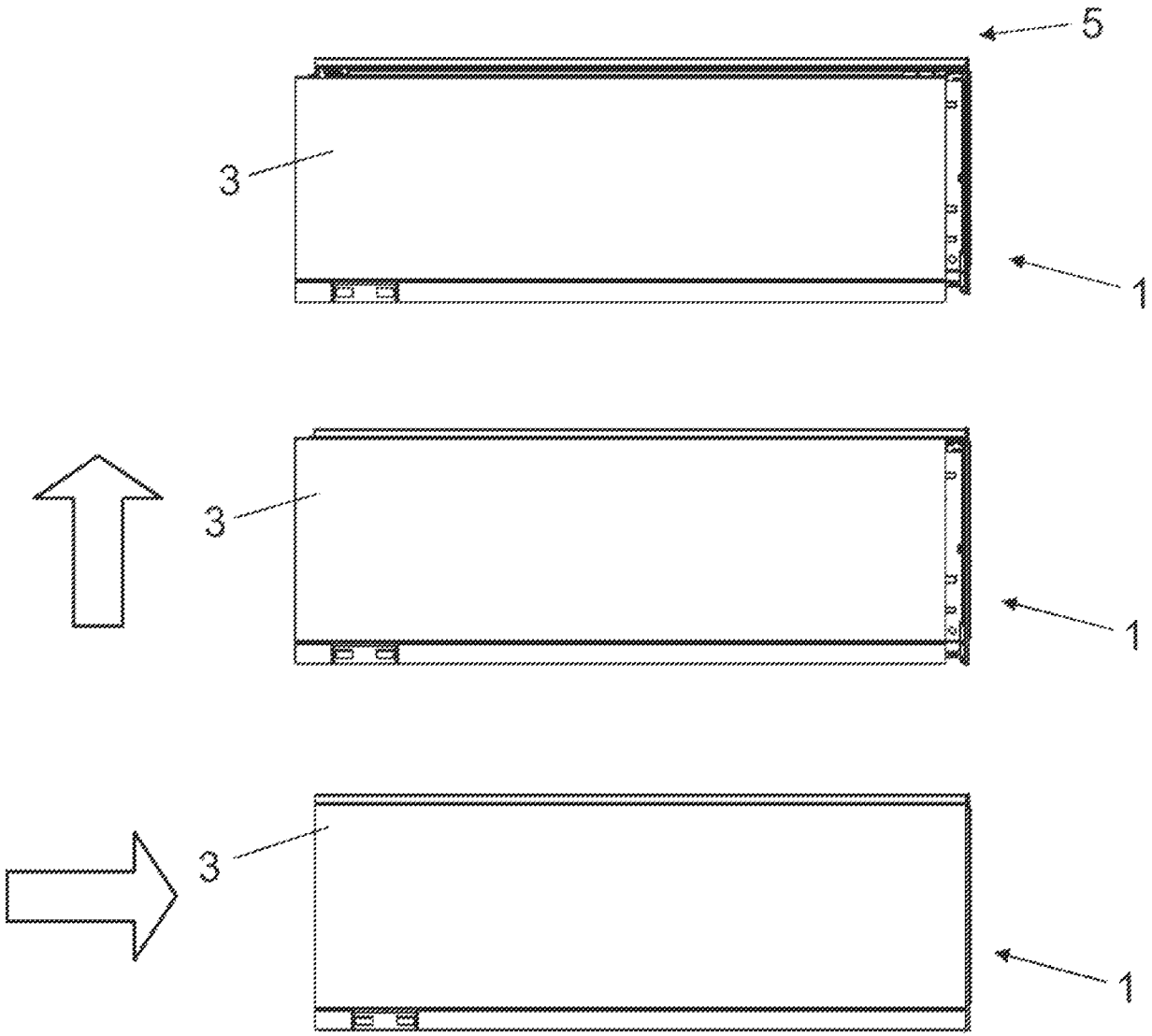

FIGS. 21*a-c* show the displacement movements of the outer wall 3 in a top view of the outer wall 3. These are part of an embodiment of a method according to the invention for producing a double-walled drawer frame 1 by hand and/or by machine.

In a first step, at least one spacer part 4 is arranged on the inner wall 2 and/or the outer wall 3, wherein this step is not shown in FIGS. 21*a-c*.

In a second step, the two walls 2, 3 are arranged substantially parallel to each other (FIG. 21*a*).

In a third step, the two walls 2, 3 are displaced relative to each other in a direction transverse to a longitudinal direction of the walls 2, 3 (FIG. 21*b*). In the course of this, the two walls 2, 3 are joined via the mounting device 6.

In a fourth step, the two walls 2, 3 are displaced relative to each other in a direction parallel to a longitudinal direction of the walls 2, 3 (FIG. 21*c*). In the course of this, the two walls 2, 3 are joined via a first holding device 71 in an end region of the guide device 5.

Figure 22:
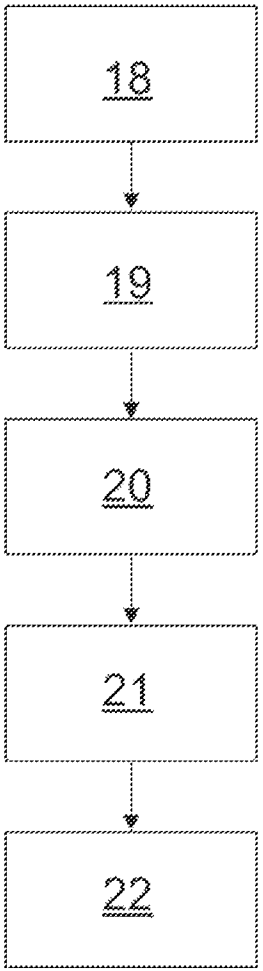
FIG. 22 illustrates a method for producing a double-walled drawer frame by machine and/or by hand.

FIG. 22 shows a block diagram of an embodiment of the method according to the invention.

A method for producing, by machine and/or by hand, a double-walled drawer frame 1 for a drawer 14 consisting of an inner wall 2 and an outer wall 3 can have the following method steps, in particular carried out chronologically in the order indicated:

In a first method step 18, at least one spacer part 4 is arranged on the inner wall 2 and/or on the outer wall 3. The assembly state of the double-walled drawer frame 1 following the first method step 18 is shown, for example, in FIGS. 4*a-d*.

In a second method step 19, the two walls 2, 3 are arranged substantially parallel to each other. The assembly state of the double-walled drawer frame 1 following the second method step 19 is shown, for example, in FIGS. 6*a-d*.

In a third method step 20, the two walls 2, 3 are displaced relative to each other in a direction transverse to a longitudinal direction of the walls 2, 3. The assembly state of the double-walled drawer frame 1 following the third method step 20 is shown, for example, in FIGS. 8*a-d*.

In a fourth method step 21, the two walls 2, 3 are displaced relative to each other in a direction parallel to a longitudinal direction of the walls 2, 3. The assembly state of the double-walled drawer frame 1 following the fourth method step 21 is shown, for example, in FIGS. 9*a-d*.

In a fifth method step 22, the two walls 2, 3 are joined in the course of the displacement movements. The joining can be effected via holding devices 7, see FIGS. 12*a-e* regarding this, for example. The joining can also be effected via the mounting device 6, see FIG. 8*c* regarding this, for example.

LIST OF REFERENCE NUMBERS

- 1 Double-walled drawer frame
- 2 Inner wall
- 3 Outer wall
- 4 Spacer part
  - 41 Slot
  - 42 Flattened edge
  - 43 Lateral face
- 5 Guide device
  - 51 Guide groove
  - 52 Guide web
  - 53 Bend of the guide groove
  - 54 Bend of the guide web
- 6 Mounting device
  - 61 Mounting groove
  - 62 Mounting web
- 7 Holding device
  - 71 First holding device
  - 72 Second holding device
  - 73 Retaining clip
  - 74 Rail
- 8 Play compensation device
  - 81 Projection
  - 82 Lateral flanks in ramp form
- 9 Front side
  - 91 Longitudinal web on the front side
- 10 Carriage connection
- 11 Container rail
- 12 Front attachment
- 13 Rear attachment
- 14 Drawer
- 15 Drawer base
- 16 Rear wall
- 17 Front panel
- 18 First method step
- 19 Second method step
- 20 Third method step
- 21 Fourth method step
- 22 Fifth method step

The invention claimed is:

1. A method of producing a double-walled drawer frame for a drawer, the drawer frame including an inner wall, an outer wall, and a spacer part therebetween, the method comprising in the order indicated:

arranging the spacer part formed of elastically compressible material on the inner wall or the outer wall, arranging the inner wall and the outer wall substantially parallel to each other, elastically compressing the spacer part, displacing the inner wall and the outer wall relative to each other in a direction parallel to a longitudinal direction of the inner wall and the outer wall, and joining the inner wall and the outer wall to each other during the displacing.

2. The method according to claim 1, further comprising compressing the spacer part when the inner wall and the outer wall are arranged substantially parallel to each other.

3. The method according to claim 1, further comprising gluing the spacer part on the outer wall and/or on the inner wall.

4. The method according to claim 1, wherein the spacer part is formed substantially cuboid-shaped, the method further comprising gluing the cuboid-shaped spacer part on a lateral face on the outer wall and/or on the inner wall.

5. The method according to claim 4, wherein an edge of the spacer part is flattened in a direction parallel to a longitudinal direction of the inner wall and the outer wall.

6. The method according to claim 1, wherein the spacer part has a slot, the method further comprising attaching the spacer part to a front side of the double-walled drawer frame between the outer wall and the inner wall by introducing a longitudinal web located on the front side into the slot.

7. The method according to claim 6, wherein the slot has an opening configured to widen in a V-shape and/or to be arranged substantially in a direction parallel to a longitudinal direction of the inner wall and the outer wall.

8. The method according to claim 1, wherein the double-walled drawer frame further includes a guide device including:

a guide groove, and a guide web, the method further comprising:

arranging the guide web in the guide groove, and displacing the guide web in the guide groove in a direction parallel to a longitudinal direction of the walls.

9. The method according to claim 8, wherein the guide groove and the guide web has a substantially semicircular bend of a sheet metal part, the method further comprising:

after or during the arranging the inner wall and the outer wall substantially parallel to each other and elastically compressing the spacer part, arranging the substantially semicircular bend of the guide web in the substantially semicircular bend of the guide groove, and wherein the displacing the inner wall and the outer wall relative to each other in a direction parallel to the longitudinal direction of the inner wall and the outer wall includes displacing the substantially semicircular bend of the guide web in the substantially semicircular bend of the guide groove.

10. The method according to claim 9, wherein a radius of the substantially semicircular bend of the guide groove is greater than a radius of the substantially semicircular bend of the guide web.

11. The method according to claim 8, wherein the outer wall and the inner wall are manufactured from sheet metal, wherein:

the guide web is manufactured from the same piece of sheet metal as the outer wall so as to have a one-piece construction with the outer wall, and/or the guide groove is manufactured from the same piece of sheet metal as the inner wall.

12. The method according to claim 11, wherein a front side of the double-walled drawer frame between the outer wall and the inner wall is manufactured from the same piece of sheet metal as the inner wall, and the guide groove is arranged at the front side.

13. The method according to claim 8, wherein the double-walled drawer frame comprises a first holding device and a second holding device for holding the guide groove on the guide web, the method further comprising:

pushing the guide web in the guide groove and into the first holding device, and affixing the second holding device to the outer wall.

14. The method according to claim 13, wherein the first holding device is arranged in a first end region of the guide groove and/or is joined to the guide groove so as to be fixed in place, and the second holding device is arranged in a second end region of the guide groove and/or is formed as a retaining clip.

15. The method according to claim 8, wherein the arranging of the guide web in the guide groove comprises displacing the inner wall and the outer wall relative to each other in a direction transverse to the longitudinal direction of the inner wall and the outer wall and/or so that the guide groove encompasses the guide web.

16. The method according to claim 1, wherein the double-walled drawer frame has a mounting device, the mounting device including:

a mounting groove formed by a bent end piece of the outer wall, and a mounting web joined to the inner wall, wherein the method further comprises:

arranging the mounting web in the mounting groove, preferably by displacing the two walls relative to each other in a direction transverse to the longitudinal direction of the walls and preferably so that the at least one mounting groove engages behind the at least one mounting web, wherein the displacing comprises displacing the mounting web in the mounting groove in the direction parallel to the longitudinal direction of the inner wall and the outer wall.

17. The method according to claim 16, wherein the mounting web comprises a play compensation device to compensate for play between the mounting groove and the mounting web, wherein the play compensation device is configured to widen the mounting web, the method comprising:

wedging the mounting web in the mounting groove by the play compensation device, and compressing the play compensation device when the mounting web is arranged in the mounting groove.

18. The method according to claim 17, wherein the play compensation device is a projection, the projection being flexible and/or having lateral flanks in ramp form.

19. The method according to claim 16, wherein the arranging of the mounting web in the mounting groove is performed by displacing the inner wall and the outer wall relative to each other in a direction transverse to the longitudinal direction of the inner wall and the outer wall so that the mounting groove engages behind the mounting web.

20. The method according to claim 1, wherein the double-walled drawer frame has a guide device and a mounting device, the guide device and the mounting device being arranged at two opposing long sides of the outer wall and/or the inner wall, the method further comprising joining the inner wall and the outer wall to each other on the two opposing long sides while displacing the inner wall and the outer wall relative to each other in a direction transverse to the longitudinal direction.

21. A double-walled drawer frame for a drawer comprising:

an inner wall, an outer wall, and a spacer part arranged between the inner wall and the outer wall, wherein the double-walled drawer frame is produced by the method according to claim 1.

22. The double-walled drawer frame according claim 21, wherein the spacer part:

is substantially cuboid-shaped, and/or has a slot.

23. The double-walled drawer frame according claim 22, wherein:

an edge of the cuboid-shaped spacer part is flattened in a direction parallel to a longitudinal direction of the inner wall and the outer wall, and the cuboid-shaped spacer part has a slot, an opening of the slot being widened in a V-shape and/or arranged substantially in a direction parallel to a longitudinal direction of the inner wall and the outer wall.

24. The double-walled drawer frame according to claim 21, further comprising a guide device including:

a guide groove, and a guide web, wherein the guide groove and the guide web has a substantially semicircular bend of a sheet metal part, and/or the guide web is manufactured from the same piece of sheet metal as the outer wall to have a one-piece construction therewith, and/or the guide groove is manufactured from the same piece of sheet metal as the inner wall to have a one-piece construction therewith.

25. The double-walled drawer frame according claim 24, wherein:

a radius of the substantially semicircular bend of the guide groove is greater than a radius of the substantially semicircular bend of the guide web, and/or a front side of the double-walled drawer frame between the outer wall and the inner wall is manufactured from the same piece of sheet metal as the inner wall to have a one-piece construction therewith, and the guide groove is arranged at the front side.

26. The double-walled drawer frame according to claim 21, further comprising a first holding device and a second holding device for holding the guide groove on a guide web.

27. The double-walled drawer frame according to claim 26, wherein:

the first holding device is arranged in a first end region of the guide groove and/or is joined to the guide groove to be fixed in place, and/or the second holding device can be arranged in a second end region of the guide groove and/or is formed as a retaining clip.

28. The double-walled drawer frame according to claim 21, further comprising a mounting device including:

a mounting groove formed by a bent end piece of the outer wall, and a mounting web joined to the inner wall to be fixed in place.

29. The double-walled drawer frame according to claim 28, wherein the mounting web comprises a play compensation device to compensate for play between the mounting groove and the mounting web, the play compensation device being configured to widen the mounting web, and the play compensation device being formed as a projection formed flexible and/or having lateral flanks in ramp form.

30. The double-walled drawer frame according to claim 21, further comprising a guide device and a mounting device, the guide device and the mounting device being arranged at two opposing long sides of the outer wall and/or inner wall.

31. A drawer comprising:

the double-walled drawer frame according to claim 21, a drawer base, a rear wall, and a front panel.

32. The method according to claim 1, further comprising also displacing the inner wall and the outer wall relative to each other in a direction transverse to the longitudinal direction of the inner wall and the outer wall.

* * * * *